US010352574B2

(12) United States Patent
Hamlin et al.

(10) Patent No.: US 10,352,574 B2
(45) Date of Patent: Jul. 16, 2019

(54) HEAT AND MASS TRANSFER DEVICES WITH WETTABLE LAYERS FOR FORMING FALLING FILMS

(71) Applicant: 3M INNOVATIVE PROPERTIES COMPANY, St. Paul, MN (US)

(72) Inventors: Thomas J. Hamlin, Vernon, CT (US); Rajeev Dhiman, Pleasanton, CA (US); Laurence W. Bassett, Killingworth, CT (US)

(73) Assignee: 3M Innovative Properties Company, St. Paul, MN (US)

( * ) Notice: Subject to any disclaimer, the term of this patent is extended or adjusted under 35 U.S.C. 154(b) by 176 days.

(21) Appl. No.: 15/529,655

(22) PCT Filed: Dec. 10, 2015

(86) PCT No.: PCT/US2015/064974

§ 371 (c)(1),
(2) Date: May 25, 2017

(87) PCT Pub. No.: WO2016/100080

PCT Pub. Date: Jun. 23, 2016

(65) Prior Publication Data

US 2017/0370598 A1 Dec. 28, 2017

Related U.S. Application Data

(60) Provisional application No. 62/091,930, filed on Dec. 15, 2014.

(51) Int. Cl.
*F24F 3/14* (2006.01)
*F24F 11/30* (2018.01)
(Continued)

(52) U.S. Cl.
CPC ..... *F24F 3/1417* (2013.01); *F24F 3/147* (2013.01); *F24F 11/30* (2018.01); *F24F 13/30* (2013.01);
(Continued)

(58) Field of Classification Search
CPC ..... F24F 3/1417; F24F 3/147; F24F 11/30; F24F 13/30; F24F 2003/1458; F24F 2110/20
(Continued)

(56) References Cited

U.S. PATENT DOCUMENTS 4,341,601 A * 7/1982 Hartig ..... B01D 1/22 203/11
4,585,523 A * 4/1986 Giddings ..... B01D 1/22 159/13.1
(Continued)

FOREIGN PATENT DOCUMENTS

CN 102961883 3/2013
CN 202876401 4/2013
(Continued)

OTHER PUBLICATIONS

Conde-Petit, Manuel, of M. Conde Engineering titled "Open Absorption System for Cooling and Air Conditioning Using Membrane Contactors", (Jul. 8, 2008).
(Continued)

*Primary Examiner* — Charles S Bushey
(74) *Attorney, Agent, or Firm* — Scott A. Baum

(57) ABSTRACT

A falling film of liquid desiccant in direct contact with a gas stream is formed, which allows water vapor transfer between a gas stream (air) and the desiccant, enabling dehumidification and/or humidification of air. Thin films are created in one way by a wettable layer that is in contact with a support structure and in another way directly on the support struc-
(Continued)

ture. The devices can be installed on an absorber (conditioner) side or a desorber (regenerator) side or both of air conditioning systems; for example, liquid desiccant air conditioning (LDAC) applications.

24 Claims, 23 Drawing Sheets

(51) Int. Cl.
*F24F 3/147* (2006.01)
*F24F 13/30* (2006.01)
*F24F 110/20* (2018.01)

(52) U.S. Cl.
CPC ... *F24F 2003/1458* (2013.01); *F24F 2110/20* (2018.01)

(58) Field of Classification Search
USPC ..... 261/101, 103, 104, 106, 108, 112.1, 261/DIG. 3, DIG. 43
See application file for complete search history.

(56) References Cited

U.S. PATENT DOCUMENTS 4,984,434 A 1/1991 Peterson
5,104,497 A * 4/1992 Tetzlaff ..... C25B 9/00 204/518
5,351,497 A 10/1994 Lowenstein
6,264,044 B1 7/2001 Meyering
6,413,070 B1 7/2002 Meyering
6,878,419 B2 4/2005 David
7,125,603 B2 10/2006 David
7,269,966 B2 9/2007 Lowenstein
7,887,889 B2 2/2011 David
2002/0073718 A1 6/2002 Maisotenko
2003/0033821 A1 2/2003 Maisotsenko
2011/0283720 A1 11/2011 Martin
2012/0186281 A1 7/2012 Vandermeulen
2014/0054013 A1 2/2014 Venmar
2014/0260399 A1 9/2014 Vandermeulen
2017/0363305 A1* 12/2017 Hamlin ..... F24F 3/14

FOREIGN PATENT DOCUMENTS

WO WO 2013/094206 6/2013
WO WO 2016/100084 6/2016

OTHER PUBLICATIONS

Park, M.S., et al., "Numerical and Experimental Results for Coupled Heat and Mass Transfer Between a Desiccant Film and Air in Cross-Flow", *International Journal of Heat and Mass Transfer*, vol. 37, Suppl. 1, pp. 395-402, (1994).
Quéré, David, "Wetting and Roughness", *Annual Review of Materials Research*, (2008) 38:71-99.
Riley, Frank, "Assembly Automation", a management Handbook, Industrial Press, New York, New York, (1983), Chapter 2.

* cited by examiner

HEAT AND MASS TRANSFER DEVICES WITH WETTABLE LAYERS FOR FORMING FALLING FILMS

CROSS REFERENCE TO RELATED APPLICATIONS

This application is a national stage filing under 35 U.S.C. 371 of PCT/US2015/064974, filed Dec. 10, 2015, which claims the benefit of U.S. Provisional Patent Application No. 62/091,930 filed Dec. 15, 2014, the disclosures of which are incorporated by reference in their entirety herein.

TECHNICAL FIELD

This disclosure relates to devices that use liquids for heat and mass transfer processes, including but not limited to air conditioning systems. Specifically, devices disclosed herein are particularly useful in systems having direct contact between gas and liquid, for example, liquid desiccant air conditioning (LDAC) applications wherein heat and mass transfer is achieved using a falling film of liquid desiccant. A heat and mass transfer panel comprises one or more liquid desiccant-wettable layers in contact with a support structure.

BACKGROUND

The use of liquid desiccants for dehumidification of air has been known for well over 75 years. The application of liquid desiccants in dehumidification in heating, ventilating, and air conditioning (HVAC) systems has been worked on for many years. Open absorption systems for air conditioning are desirable due to their relatively simple design and driving energy at relatively low temperatures. Liquid desiccant air conditioning (LDAC) is an exemplary open absorption system.

Heat and mass exchange (HMX) modules have been researched and attempted for use in LDAC systems. Some module designs incorporated three fluid paths: one for desiccant, one for air, and one for coolant; and other designs incorporate two fluid paths: one for desiccant and one for air. Certain designs have provided benefits on the performance of the absorber side of the system but not on the desorber side, and overall commercial success of liquid desiccant air conditioning (LDAC) systems has been extremely limited.

U.S. Pat. No. 7,269,966 (Lowenstein) discloses a heat and mass exchange assembly having a wettable substrate positioned in spaces between adjacent plates and in contact with adjacent plates in a plurality of locations along with a liquid supply assembly, which delivers the liquid from a source to upper regions of the plates.

SUMMARY

Provided are heat and mass transfer devices: components, panels, modules, and systems, and methods of making and using the same.

In one aspect, a heat and mass transfer module comprises: one or more support structures; one or more wettable layers in contact with the support structure; a gas contact zone adjacent to the wettable layer; a fluid distribution system comprising one or more headers that define a fluid reservoir; and a fluid collection system comprising one or more footers having a stepped feature; and at least one end plate.

Other features that may be used individually or in combination with respect to any aspect of the invention are as follows.

The wettable layers may be effective to form a falling film of a liquid desiccant upon receipt of a gravity feed of the liquid desiccant.

The heat and mass transfer module may further comprise two end plates. The heat and mass transfer module may comprise a plurality of panels. The fluid distribution system may comprise a plurality of shims located between the plurality of panels. The heat and mass transfer module may further comprise an air inlet opening and an air outlet opening, wherein air flow is cross-flow to desiccant flow. The heat and mass transfer module may further comprise one or both of the following: a first air filter upstream of the air inlet opening and a second air filter downstream of the air outlet opening. The first and second air filters independently comprise a pleated air filter.

In one or more embodiments, upon receipt of desiccant flow, the panel may comprise an upper liquid seal and a lower liquid seal, which are effective to inhibit loss of air through the fluid distribution system and the fluid collection system, respectively.

The fluid distribution system may comprise a plurality of headers arranged such that a plurality of air flow gaps are defined therebetween. The air flow gaps may be substantially uniform. Each of the headers may comprise desiccant flow features.

The fluid collection system may comprise a plurality of footers arranged such that a plurality of collection gaps are defined therebetween. Each footer comprises a stepped feature to form a reservoir defined by the footer at the outlet end of the layer. The collection gaps may be are substantially uniform.

Another aspect provides a heat and mass transfer system comprising: any one or more modules disclosed herein; and a desiccant supply. The heat and mass transfer system may further comprise a heat transfer fluid supply. The heat and mass transfer system may comprise: a first module that upon contact with air having a water vapor pressure higher than the equilibrium vapor pressure of the desiccant, is effective to transfer water vapor from the air to a desiccant flowing through the desiccant channel; and a second module that upon contact with air having a water vapor pressure lower than the equilibrium vapor pressure of the desiccant is effective to transfer water vapor from the desiccant to the air. The heat and mass transfer system may further comprise a sensible heat exchanger downstream of the first module.

In a further aspect, provide is a method for water vapor exchange between air and a liquid desiccant, the method comprising: contacting any module disclosed herein with air having a water vapor pressure different from the equilibrium vapor pressure in a desiccant flowing through the desiccant flow channel; wherein the humidity of the air after contact with the module is different from the humidity before contact with the module. The water vapor pressure of the air may be higher than the equilibrium vapor pressure of the desiccant, and the method further comprises transferring the water vapor from the air to the desiccant, and the humidity of the air after contact with the module is less than the humidity before contact with the module. The equilibrium vapor pressure of the desiccant may be higher than the water vapor pressure of the air, and the method may further comprise transferring the water vapor from the desiccant to the air, and the humidity of the air after contact with the module is more than the humidity before contact with the module.

Another aspect is a method of making a heat and mass transfer module, the method comprising: forming a gas contact zone adjacent to one or more support structures by assembling the one or more support structures with at least one end plate, a fluid distribution system comprising one or more headers that define a fluid reservoir, and a fluid collection system comprising one or more footers having a stepped feature to form the module. The method may further comprise contacting the one or more support structures with one or more wettable layers.

These and other aspects of the invention are described in the detailed description below. In no event should the above summary be construed as a limitation on the claimed subject matter.

BRIEF DESCRIPTION OF THE DRAWINGS

The accompanying drawings are included to provide a further understanding of the invention described herein and are incorporated in and constitute a part of this specification. The drawings illustrate exemplary embodiments. Certain features may be better understood by reference to the following detailed description when considered in connection with the accompanying drawings, in which like reference numerals designate like parts throughout the figures thereof, and wherein.

The figures are not necessarily to scale. Like numbers used in the figures refer to like components. It will be understood, however, that the use of a number to refer to a component in a given figure is not intended to limit the component in another figure labeled with the same number.

DETAILED DESCRIPTION

Figure 1:
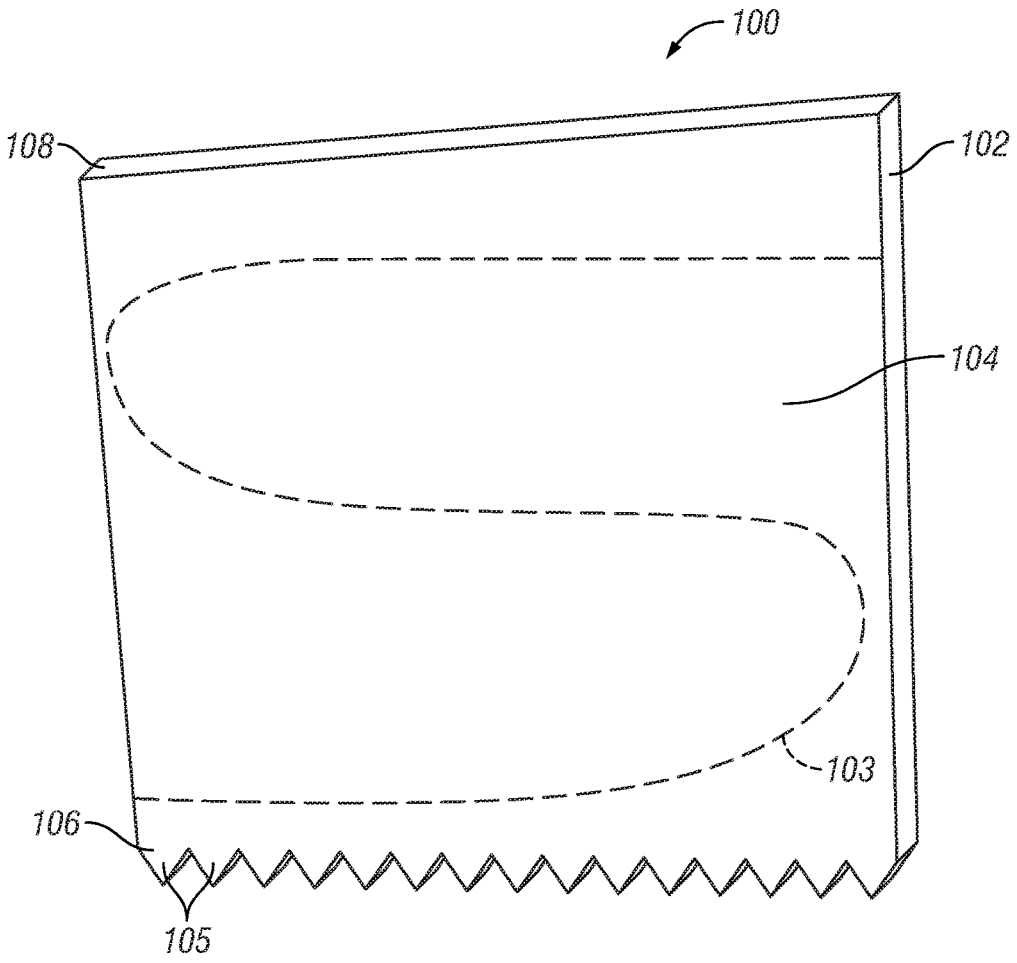
FIG. 1 is a perspective schematic of an exemplary heat and mass transfer component.

Provided are devices that use liquids for heat and mass transfer processes, including but not limited to air conditioning systems, for example, liquid desiccant air conditioning (LDAC) applications allowing heat and water vapor transfer directly between the air and liquid desiccant, which enable dehumidification and/or humidification of the air. The devices may be installed on an absorber (conditioner) side or a desorber (regenerator) side or both of a LDAC system.

In direct contact heat and mass transfer systems using gravity feed, it is desirable to have a thin film of liquid in contact with a gas stream. Creating the thin film minimizes carryover (aerosolization) of the liquid when exposed to the gas stream. This has importance, for example, in LDAC applications that utilize a corrosive salt (typically an aqueous lithium chloride solution ($LiCl/H_2O$) as the heat and mass transfer fluid. To facilitate formation of a thin film of liquid, desiccant, for example, a wettable layer that is in contact with a support structure is used. The layers are substantially smooth, which are substantially free of protrusions that may lead to aerosolization and/or undesired flow not in the direction of gravity. It may be advantageous for the layer to be movable with respect to the support structure. That is, the layer may slip or slide on the support structure, but will generally be held in contact with the support structure by surface tension. Some designs may attach the layer to the support at one location, for example along the top edge of both the layer and the support structure. Other designs may tack the layer to the support structure at various locations. The wettable layer and support structure combined component is easily prepared in any size and shape as needed. The component, in turn, is assembled with other easily customizable parts to form panels and modules. The overall design uses a minimum number of pieces, which is suitable for automated assembly. Such a strategy provides a simple and economical way to achieve excellent heat and mass transfer.

The following terms shall have, for the purposes of this application, the respective meanings set forth below.

A "heat and mass transfer component" is a structure used in combination with other components for achieving mass and/or heat transfer. Components provide the fundamental function of forming a falling film of a desiccant. An exemplary component comprises a support structure and a wettable layer contacting the support structure. The film is formed from a gravity feed of liquid desiccant in and/or on the wettable layer.

A "heat and mass transfer panel" provides multiple functionalities such as water vapor separation, control of the formation of the falling film, and distribution and retention of the desiccant. Panels may comprise any heat and mass transfer component disclosed herein and a gas contact zone adjacent the layer in combination with a fluid distribution system.

A "gas contact zone" is an area where a gas, such as air, directly contacts a liquid, such as liquid desiccant, to result in heat and mass transfer.

A "fluid distribution system" contains features that control delivery of a fluid, such as liquid desiccant. That is, the fluid distribution system defines the location, amount, and flow rate of the fluid being delivered to the heat and mass transfer component.

A "fluid collection system" contains features that control receipt of a fluid, such as liquid desiccant. That is, the fluid collection system defines the location, amount, and flow rate of the fluid being removed from the heat and mass transfer component.

A "heat and mass transfer module" is an assembly of several panels to achieve mass and/or heat transfer in practical commercial quantities.

A "heat and mass transfer system" is a combination of at least one module with one or more fluid supplies (desiccant, for example) and other heat and mass transfer units to implement mass and/or heat transfer at a desired location.

"Hydrophilic", "philic," or "wettable" means that the liquid desiccant is able to wet the interstitial surfaces of the layer and invade and wet pores of the layer. This effect can be quantified by Eq. (1) which gives the criterion for a liquid to invade a textured solid depending on its intrinsic wettability with the solid and the details of the textures:

$$\cos\theta \geq \frac{1-\phi_s}{r-\phi_s} \tag{1}$$

where θ is the contact angle of the liquid with the solid without any textures (i.e. smooth), $\phi$, is the fraction of the projected area that is occupied by the solid (between 0 and 1), and r (≤1) is the ratio of true surface area of the solid to its projected area. For a porous solid, r is infinity, which implies that θ≤90°, i.e. any liquid with contact angle less than 90° will eventually invade a porous material. Eq. (1) merely predicts whether or not a given liquid will invade a porous solid, but it does not predict how quickly this will happen. This feature of a porous material distinguishes it from solids having textures only on their surfaces where the condition for liquid invasion is more restrictive. For example, for $\phi_s$=0.1 and r=2, θ≤62°, implying that only liquids with contact angle less than 62° will be able to invade the solid textures. Thus "hydrophilic" in this context means θ≤90°, preferably θ should be as small as possible and preferably θ≤75°. (David Quéré. Annual Review of Materials Research. 2008. 38:71-99.)

A "wettable layer" refers to a material that is thin relative to its length and width and is wettable by liquid desiccant solutions. One way to measure wettability is to contact a dry sheet with a desired desiccant and determine the time it takes for the desired desiccant to fully wet the sheet. For example, a dry sheet that fully wets a drop of a lithium chloride solution (nominally 35% concentration) in 300 seconds (or even 60, or even 30 seconds) or less is wettable. Reference to "fully wets" means that no visible bead or drop is left on the surface of the sheet in a horizontal orientation (Horizontal Wicking Test).

Suitable wettable layers have surfaces and thicknesses that are effective to form falling films while minimizing aerosolization. Desirable surfaces are those having a topography that is substantially smooth, having minimal to no individual projections or protrusions. That is, from a macrostructure standpoint, the surfaces are fairly even, but on a microstructure standpoint, the materials are constructed to promote flow. For layers comprising fibers, therefore, preferred embodiments are those where the fibers are directionally oriented in the plane of flow. For layers comprising membranes, the surfaces are inherently smooth. Thicknesses of membranes are on the order of 1 to 15 mils, or even 1 to 10 mils. Thicknesses of fibrous layers are on the order of 1 to 125 mils or even 1 to 50 mils.

Preferred wettable layers are also, in any combination, flexible, continuous, discrete, and/or uniform. Reference to flexible means structures that are non-rigid and can be rolled onto itself and unrolled without damage. In one or more embodiments, such structures may be rolled 180 degrees around a radius that is less than or equal to five (or two and one-half, or even less than or equal to one) times the thickness of the layer without damage. Reference to continuous material means that the layer is uninterrupted and the heat and mass exchange surfaces of the support structure are entirely covered by the layer. A layer that is substantially uniform in that its formation results in a material whose cross-section is consistent in terms of pore volume and/or thickness. A discrete layer is one that is separately formed from the support structure and may be removed from the support structure intact.

A "wettable membrane," for example, refers to a flexible, discrete, continuous, and substantially uniform structure that is wettable by liquid desiccant solutions. One way to measure wettability is to contact a dry membrane with a desired desiccant and determine the time it takes for the desired desiccant to fully wet the membrane. For example, a dry membrane that fully wets with a drop of a lithium chloride solution (nominally 35% concentration) in 300 seconds (or even 60, or even 30 seconds) or less is wettable. Reference to "fully wets" means that no visible bead or drop is left on the surface of the membrane. The membranes are wettable or hydrophilic by virtue of the materials used to fabricate the layer and/or by being modified. Exemplary membranes are microporous, for example, suitable for micro-filtration (MF) or ultra-filtration (UF). Other exemplary membranes are ones that are directly formed on a nonporous substrate. For example, a nylon dope may be cast onto a nonporous nylon film or Micarta plate, the dope being polymerized under phase inversion conditions, which results in the formation of a nylon membrane directly on the substrate. Such a nylon membrane would be a continuous layer on the film or plate.

A "wettable fibrous sheet," for example, refers to a flexible, discrete, continuous, and substantially uniform structure formed from fibers of any material that is wettable by liquid desiccant solutions. One way to measure wettability is to contact a dry fibrous sheet with a desired desiccant and determine the time it takes for the desired desiccant to fully wet the fibrous sheet. For example, a dry fibrous sheet that fully wets a drop of a lithium chloride solution (nominally 35% concentration) in 300 seconds (or even 60, or even 30 seconds) or less is wettable. Reference to "fully wets" means that no visible bead or drop is left on the surface of the sheet. The fibrous sheets are wettable or hydrophilic by virtue of the materials used to fabricate the layer and/or by being modified.

A "heat transfer fluid" is a material that is at least effective to transfer of heat from one medium to another. Usually, heat transfer fluids are used in closed systems and are stable under such conditions. An exemplary heat transfer fluid is water. Other exemplary fluids include, but are not limited to: aqueous glycol solutions (for example, ethylene glycol, diethylene glycol, or propylene glycol); refrigerants, which undergo phase changes between liquid and gas during use (for example, halomethanes, liquefied propane, and carbon dioxide); and oils (for example, mineral oils, silicone oils, fluorocarbon oils, and synthetic oils). Reference to heat transfer fluids includes those fluids effective for both heat and mass transfer.

A "heat and mass transfer fluid" is a material that is effective to achieve both a transfer of heat from one medium to another and a transfer of mass from one medium to another. Liquid desiccants are one type of heat and mass transfer fluid.

A "liquid desiccant" is a hygroscopic material which has the ability to both absorb or desorb water vapor into or from solution based on partial pressure differences. Examples of suitable desiccants are halide salts (such as lithium chloride, calcium chloride, and mixtures thereof, and lithium bromide) and glycols (such as triethylene and propylene glycol).

Reference to "modified" with respect to a layer means that the layer is rendered hydrophilic, which is needed, for example, when a polymer that is intrinsically hydrophobic is used to form a layer or when it is desired to enhance the desiccant wettability of any material. The membrane is treated in some manner to render it hydrophilic. To render a membrane hydrophilic, modifications include, but are not limited to, including a co-polymer in the dope used to prepare the membrane, post-treating the membrane with a coating, oxidizing the membrane, and plasma-treating the membrane.

A "porous membrane" is a permeable separation material having pores as part of its structure.

Use of the term "microporous membrane" herein is intended to encompass microporous membranes having an average pore size in the range of from about 0.02 to about 10.0 microns; and a maximum pore size in the range of 0.1 to 15 microns.

The term "pore size" refers to a measurement of pores of a membrane. "Mean Flow Pore" may be determined by the appropriate ASTM-F316-70 and/or ASTMF316-70 (Reapproved 1976) tests. Maximum pore size may be determined by a "First Bubble Point" measurement in accordance with by ASTM F-316-03. For integrally-formed membranes, scanning electron microscope (SEM) images may be used to determine mean or maximum pore size.

"Thin film" is coverage of the desiccant on the surface of the layer. On wettable materials, liquid desiccant starts flowing in "ribbons," which is a flat area of liquid desiccant with a low contact angle that penetrates into and spreads over the layer. It is noted that non-wettable materials will not form ribbons, rather "beads" occur due to a large contact angle. Amount or percent of surface coverage in light of discrete ribbons may vary as needed depending on the application of the LDAC. In some instances the coverage may be at least 25%, 50%, 75%, or more. In some embodiments, the coverage is 100%. Film thickness on membranes may be in the range of 10 to 50 mils. Film thickness on fibrous sheets may be in the range of <1-50 mils. As the film thickness decreases, the flow is primarily in the layer.

Reference to "falling film" means that liquid desiccant flowing downward due to gravity can occur both in and/or on the wettable layer. A falling film can include a thin film on the surface of the layer.

Reference to "lateral flow" means flow occurring in the macrostructure and microstructure of the layer, for example, channels formed by fibers and/or micropores in a membrane or in a fibrous sheet. In general, macrostructures enable lateral flow due to gravity when a layer is oriented in the vertical direction. Microstructures generally enable lateral flow due to wicking.

Reference to "multi-scale" or "dual scale" means structures of the layer alone or combination with a support structure have at least two nominally different sizes and/or shapes and/or materials and/or features. The presence of a multi- or dual scale encourages a combination of lateral flow due to wicking forces and bulk flow in larger connected pores or channels due to gravity.

Wettable Layer

The use of a wettable layer in contact with a support structure facilitates formation of a falling film, which simplifies formation of direct contact heat and mass transfer panels, modules, and overall systems. The layers may be, in any combination, flexible, continuous, discrete, and/or uniform which provides predictability in their ability to form the falling film. Surfaces of the layers are substantially smooth, thereby minimizing the potential for aerosolization of the desiccant liquid. The layers are useful in the designs described herein because they are effective in retaining a liquid in the majority of the pore structure due to capillary action when oriented in a vertical direction. Layers may be made from any material that may be rendered wettable, either intrinsically or by treatment. Materials for layers include but are not limited to cellulosic materials and to polymeric materials such as thermoset plastics and thermoplastics. Porous membranes are one type of suitable layer. Fibrous sheets are another type of suitable layer. Layers may be composites or laminates of suitable materials/structures. Thickness of layers may be chosen for particular applications and desiccant flows, and may be in the range of 1-50 mils. Layers that are instantly wettable by a liquid desiccant at various concentrations, such as a 5-50 wt-%, 10-45 wt-%, or 30-40 wt %, or even 35 wt % LiCl solution and that have robust compatibility with the LiCl solution over a range of temperatures of up to 60° C. are preferred. A useful range, typical of dehumidification applications is a concentration of 30-40 wt %.

A discrete layer of material affixed to a panel is a particularly useful embodiment. In particular a discrete layer which is substantially smooth is useful in that it minimizes the risk of desiccant carryover. At the macro-scale, fibrous materials that do not contain fiber projections perpendicular to the surface of the media render them substantially smooth. Membranes are inherently smooth at the macro-scale in that there are no fibers and thus it is not possible to have fibrous projections perpendicular to the surface. At the micro-scale, the surfaces of the membrane structure and the surfaces of the fibers may have surface roughness which can assist with wettability. This type of surface roughness at the micro-scale is not visible to the naked eye and is different than the smooth surface presented at the macro-scale. Micro-scale features will be covered with a film of desiccant during operation which will be difficult to aerosolize due to surface tension. The smooth surface prevents fibrous projections into the air stream which are prone to creating aerosolized droplets of desiccant.

An example of a membrane material that has a smooth surface and is a useful layer is nylon membrane BLA080 from 3M Purification Inc. An example of a fibrous sheet that has a smooth surface and is useful as a layer is Reemay® 2214 spunbond polyester media from Fiberweb Inc. Both of these materials can be plasma modified to improve wettability. An example of a wet-laid cellulosic and glass media which is substantially smooth and is a useful layer is 1MDS media from 3M Purification Inc. Spunbonded materials are produced in a continuous manner which creates continuous fibers that are inter-tangled and collected using a vacuum pulling through a porous moving collector belt. This creates a continuous fibrous structure with the fibers oriented parallel to the surface of the media which creates a substantially smooth surface. The media can be further calendared using compression rollers and optional heating to further increase surface smoothness. Wet-laid materials are formed by creating a slurry composed typically of water and suspended fibers which are introduced to a porous moving belt through which vacuum is pulled. The vacuum dewaters the slurry and causes the fibers to lay down in an orientation generally parallel to the surface of the media which creates a substantially smooth surface. The wet laid media can be further calendared using compression rollers to increase surface smoothness.

Discrete layers are also useful in that they do not have to be affixed to a support structure except at a relatively few points in order to secure the layer prior to introduction of the liquid desiccant. As the liquid desiccant is introduced through the header, the natural effects of surface tension allow the layer to conform and adapt to the support surface on the panel as it wets out. The material sticks to the surface of the support structure but can move and adapt so that wrinkling and buckling of the discrete layer is minimized. The panel has to operate over a wide range of temperatures, particularly when one considers the need for the panel to operate in both the conditioning and regeneration modes, and the discrete layer with relatively few attachment points to the support structure can expand and contract at different rates than the support structure without wrinkling or buckling. Wrinkling and buckling increases the chance of carryover as the surface of the layer becomes irregular relative to the air stream. It is particularly useful to affix the discrete layer near the top of the panel or at the header location while attachment in the rest of the panel can be minimized. This allows the discrete layer to move and adjust relative to the support structure as the liquid desiccant is introduced and during the expansion and contraction of the panel expected in the application.

The thin film formed on the surface of the wettable layer does not need to provide full coverage over the entire wetted surface. Ribbons of film flowing down the surface will allow the surface to still function effectively in a heat and mass transfer panel. This is because the wetted layer has desiccant distributed in its pores or between fibers and ribbons of film passing near areas that are not covered by a ribbon still experience conductive heat transfer and diffusive salt migration. In addition, there is still a small amount of desiccant flow occurring within the layer so there is some kinetic mixing at the boundaries with the flowing ribbons. The wetted layer insures that the ribbons are flat (i.e. each ribbon is a thin film) and this minimizes the probability of carryover due to aerosolization of the desiccant. The hydrophobic features on the layer can be added to further enhance the formation of the ribbons and insure the ribbons are distributed across the width of the wettable layer.

Once liquid desiccant has imbibed the layer, e.g., pores of a membrane or fibers of a sheet, some retention of the fluid in the layer is an advantageous feature. Retention of fluid in the layer can occur in the pore structure or on surfaces of wettable fibers or on interstitial surfaces of a wettable membrane. At normal ambient conditions, the liquid desiccant will not dry out and the layer will remain wet and ready for use. This is particularly useful when restarting the formation of the film after a down period or cycle. Restarts of desiccant flow on a supported wettable membrane layer after dwell periods can sometimes result in a film that does not fully reform but tends to form fingers of flow. Theoretically, this can be explained by Rayleigh-Taylor Instability which occurs at the interface of the liquid film flowing down the face of the layer. This flow front instability explains the tendency of the fluid to form into fingers at multiples of regular intervals (i.e. distance between the center of each finger) and gather into multiple fluid streams rather than form a continuous film. Managing spreading of the flow on the panel may be accomplished by providing desiccant-phobic lanes or other patterns directly on the membrane surface and thus influence fluid coverage across the panel.

Figure 19A:
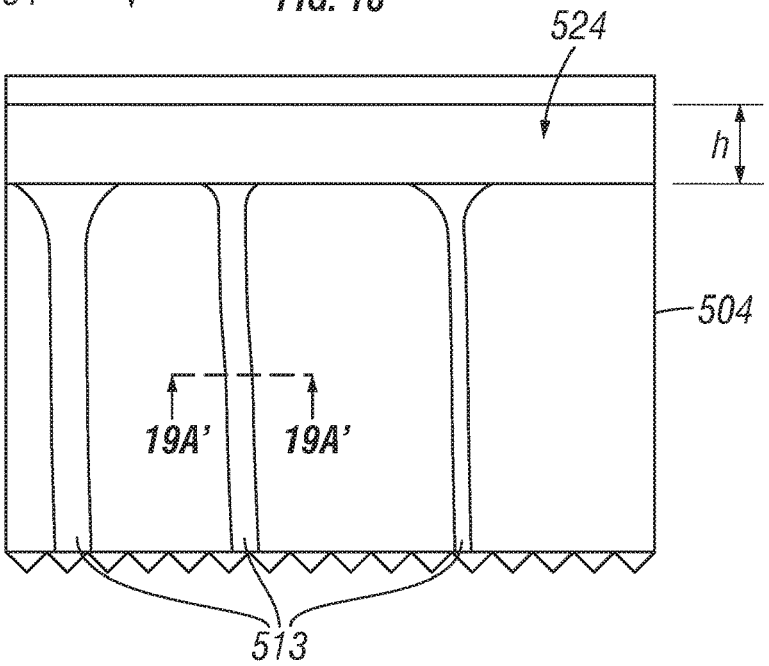
FIG. 19A provides a schematic of the formation of thin ribbons or films, FIG. 19A' provides a cross-section of the formation of thin ribbons or films, and FIG. 20A provides a photograph of the formation of thin ribbons or films.
Figure 19A:
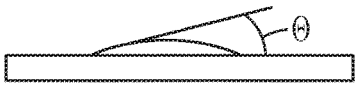
Figure 19B:
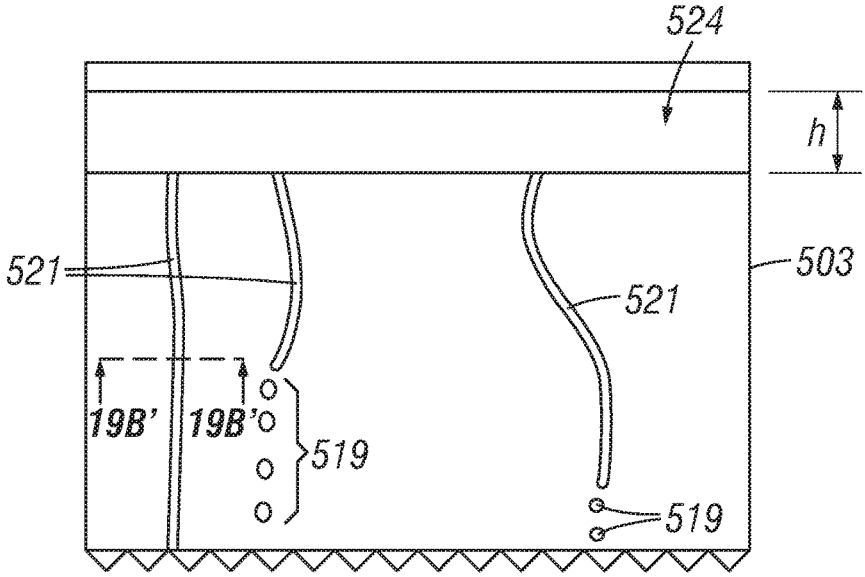
FIG. 19B provides a schematic of the formation of beads or rivulets for comparison to FIG. 19A, FIG. 19B' provides a cross-section of the formation of beads or rivulets for comparison to FIG. 19A', and FIG. 20B provides a photograph of the formation of beads or rivulets for comparison to FIG. 20A.
Figure 19B:
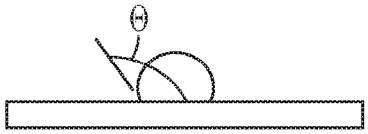
Figure 20A:
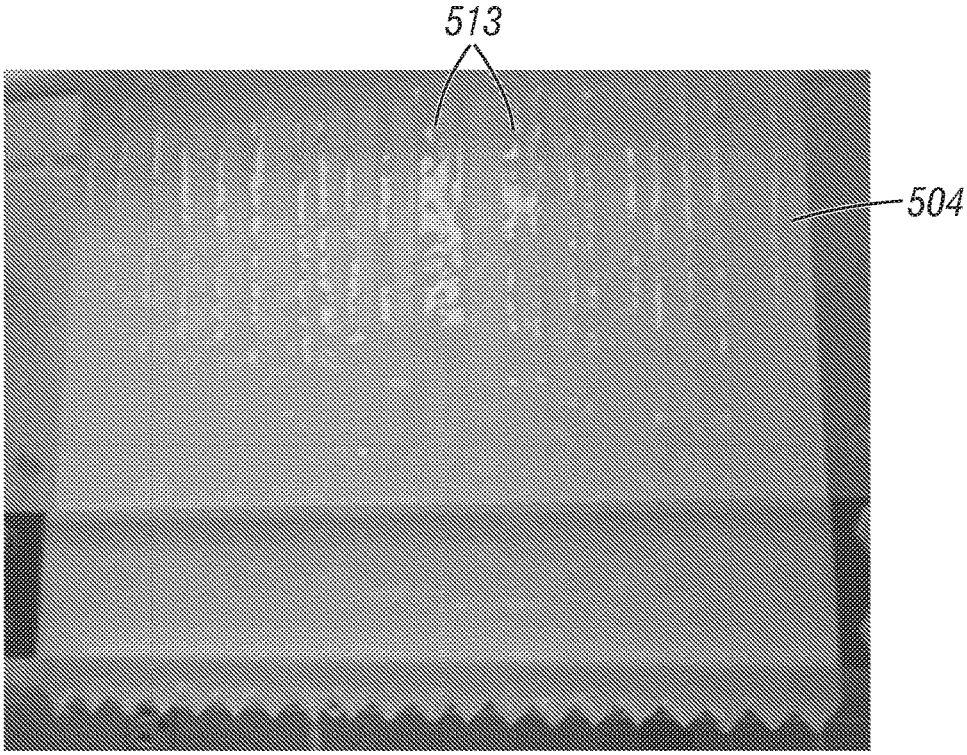
Figure 20B:
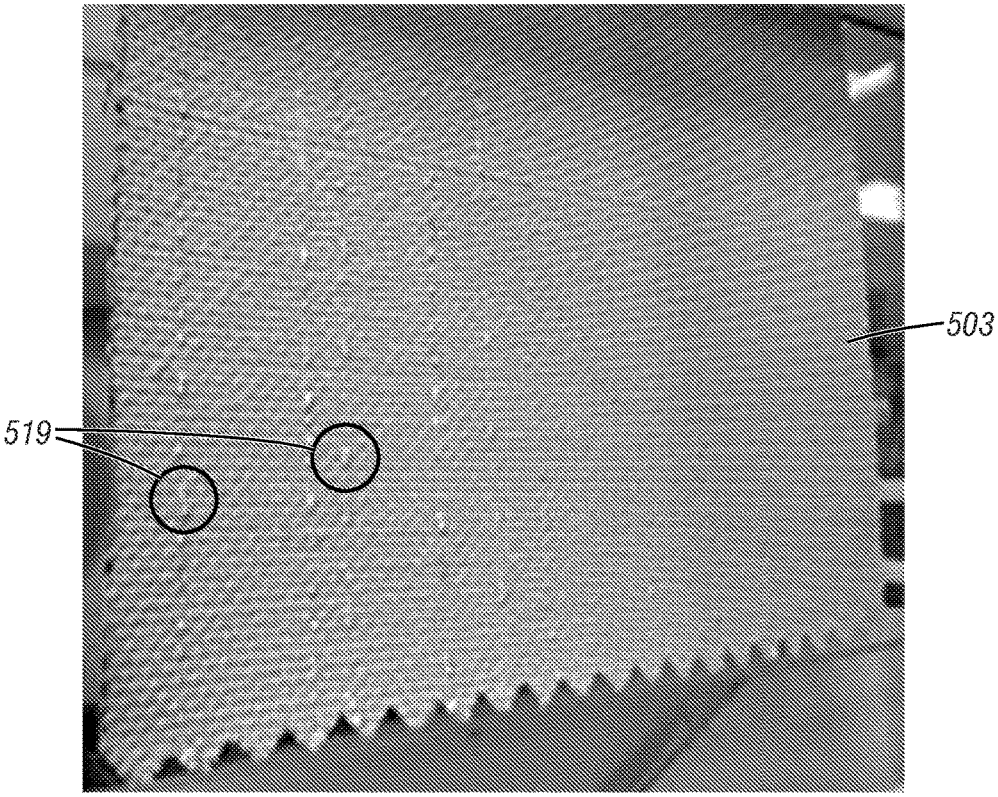

Liquid flow in falling film panels described in this disclosure depends on the wettability of the underlying surface layer with the liquid. FIG. 19A shows a front view schematic of the cross-section of the partial heat and mass transfer panel of FIG. 5, where the falling film on the wettable layer 504 as formed by desiccant supplied by the liquid reservoir 524 is in the form of liquid ribbons 513. Good wettability is characterized by low contact angles (θ in FIG. 19A'), which leads to formation of thin ribbons or films. FIG. 19B is a comparative schematic showing a front view of a partial heat and mass transfer panel, where beads 519 and rivulets 521 are formed by desiccant supplied by the liquid reservoir 524 to a non-wettable layer 503. Poor wettability is characterized by high contact angles (θ in FIG. 193), which leads to formation of flowing beads or meandering rivulets. A photograph of ribbon flow 513 is shown in FIG. 20A where the liquid desiccant (LiCl, 35% concentration) flows through and over a plasma-treated nylon membrane 504. On the other hand, FIG. 20B shows a photograph of the same desiccant over a waxed cotton surface 503, which is non-wettable, leading to formation of beads 519.

When the desiccant is introduced onto the surface of a wettable layer, the ribbons will typically be covering greater than 25% of the surface and more commonly will cover greater than 50% of the surface. When the highest performance of a panel in terms of heat and mass transfer is required, greater than 75% (85%, 90%, 95%, or even 99%) of the surface area will be covered. In some embodiments 100% of the surface area is covered. Increasing flow of the desiccant liquid by manipulating the liquid head and gap geometry at the top of the layer is possible. Higher flows will increase coverage of the panel with a more continuous film. In a given design, gap geometry is set and the flow rate is controlled by varying the liquid head at the top of the layer. The amount of liquid desiccant flowing within the layer and on the layer is then a function of the properties of the layer.

In general, membranes have significantly lower lateral flow rates and tend to generate more flow on the surface of the membrane. Fibrous sheets generally can support more flow within the layer and enable thinner surface films on the layer. In other words, the lateral flow capacity of fibrous porous materials is significantly higher than that of a membrane. Layers with high lateral flow wicking rates for the 35% LiCl solution are particularly useful. In addition, flow capacity can be manipulated by increasing or decreasing the thickness of the layer as the capacity of the layer for lateral flow is also a function of the thickness. Fibrous layers may also be lower in cost than membranes.

Less useful materials include flocked surfaces which have fibers anchored to a base material at one end and then directionally point the fibers outward. This inhibits the ability to have fibers primarily in the plane of flow. Also, materials produced by coating surfaces with particles inherently have a low lateral flow capacity and are not particularly useful in the type of heat and mass transfer panel of this design.

The layer can be produced in a cost effective manner and cut to a variety of shapes as needed. A series of features, for example, draw-and-drip features, may be added to the bottom of the layer. These features cause the desiccant to "draw" or "drip" uniformly. Crowns, points, or other draw-and-drip features can be added to the layer to enhance spreading of the liquid film at the bottom of the layer and promote uniform departure of the film off the layer when it is mounted in a vertical orientation.

The surface of the layer may be further modified to provide a multi- or dual scale such that features that enhance flow and/or distribution are added to the layer. For example, the layer may be further modified to create liquid phobic patterns, channels, or lanes which manage and spread liquid flow down the face of the layer and assist in overcoming flow front instability. Phobic patterning, channeling, or lanes may be extended into the pore structure of the membrane or into the fiber structure of the fibrous sheet. The phobic areas enhance the spreading of the liquid film into a thin layer, thereby enhancing the ability of the film to efficiently transfer heat and mass. Forming phobic patterns may be achieved, for example, by dispensing a phobic material, such as an adhesive (i.e., silicone), onto the layer and/or by printing a phobic material, such as an ink, onto the layer.

The liquid phobic patterns can also be used to direct or restrict flow to selected areas of the layer surface which can be useful in sequestering the fluid to discrete locations. Lanes are a particularly useful embodiment. That is, the thin film may be made up of a series of ribbons running down lanes created by hydrophobic patterning on the layer. Creation of phobic areas may be done in many ways, including but not being limited to: using liquid phobic paints, inks, or other coatings, using adhesives, or heat embossing and collapsing the membrane pore structure or the fiber structure of the sheet to modify the surface energy and liquid wetting characteristics to create the lanes or other patterns. The modifications can occur at the surface and may or may not extend into the pore or fiber structure. Modifications can be made on one side or both sides of the layer. Modifications at the surface still allow fluid within the layer to fully wet the pores and to flow within the layer structure which may be useful in enhancing heat and mass transfer with the falling film. Modifications into the pore or fiber structure could be used to limit fluid crossover within the structure. Patterns do not need to be limited to stripes. A whole range of lines or curves can be created that force or inhibit liquid flow to certain areas of the panel. These patterns are most useful if they improve the film coverage on the layer. Although many different patterns are possible, the preferred embodiment of this idea is to create lanes which are bordered by liquid phobic lines or stripes. The lanes preferably extend up into the header so that as fluid exits the header, it stays in a designated lane. The phobic stripes keep fluid in a given lane as it moves down the layer and thus layer coverage with the fluid film is significantly enhanced. The lanes are preferably spaced at the intervals that are observed as the normal interval for fingering to occur in a given layer. Any draw-and-drip features present in conjunction with laning may have at least one feature (i.e., crown or point) per lane. This further enhances uniform film spreading and flow down the face of the layer. It is also useful that the film falling down the panel in lanes forms a set of "speed bumps" so that if a gas is introduced flowing in a cross-flow direction to the flow of the liquid desiccant, the natural shape of the film introduces irregularities that create mixing of the gas at the boundary layer and thus enhance heat and mass transfer between the gas and the liquid.

Another possible way to modify the surface of the layer to enhance flow and/or distribution is to emboss, calendar, or otherwise mechanically modify it to compress and/or form features such as patterns, channels, or lanes that enhance flow and/or distribution.

Wettable layers are designed to be stably wettable after prolonged aging for at least six months in a dry state with an expected stability in the range of at least 1 day to an excess of 1 year. This is useful because it allows the manufacture of the wettable layers, for example porous membranes or fibrous sheets, to be prepared well in advance of the commission of any LDAC systems. Likewise, any part containing the wettable layer can therefore be stably stored dry up until the time it is put into service and put into contact with a liquid desiccant.

Wettable Porous Membrane

Wettable porous membranes facilitate formation of a falling film layer. Membranes are useful in the designs described herein because they generally have a substantially smooth surface that is well-defined and uniform, well-defined pore morphology, and they are also effective in providing lateral flow by retaining a liquid in the majority of the pore structure due to capillary action when oriented in a vertical direction. They also can be cost-effectively manufactured and surface modified in a roll-to-roll process. In turn, low-cost, easy-to-manufacture heat and mass exchangers may be constructed.

The film formation on the wettable porous membrane occurs in combination with a gravity feed desiccant flow system. A porous membrane suitable for use herein is easily imbibed with a wetting fluid that has a high surface tension. The membrane, when mounted in a vertical position, has the ability to sequester the liquid in the pores and create a liquid slip surface. The liquid slip surface significantly enhances the ability to form a thin falling film.

The porous membrane is rendered wettable or hydrophilic, and surface modifications applied herein to the membrane for increasing wettability are durable and shelf-life stable.

The membrane can be optimized in terms of material choice, thickness, pore size, surface treatment, and surface area for a given heat and mass transfer application. Exemplary microporous membranes have an average pore size in the range of from about 0.02 to about 10.0 microns; and a maximum pore size in the range of 0.1 to 15 microns. Examples of how pore size and structure can be further manipulated in the case of nylon membranes can be found in U.S. Pat. Nos. 6,264,044 and 6,413,070, which are incorporated herein by reference.

A membrane layer could have a dual scale by the addition of one or more surface features to its microporous structure.

Surface features include but are not limited to surface modifications by, for example, embossing, calendaring, or other mechanical change; and/or the addition of liquid phobic patterns. As an example, a wettable membrane which has been embossed may provide a second scale for surface/bulk flow. The embossed side of the membrane may be placed against the support structure to allow for bulk flow.

Surface-modified porous nylon membranes with pore sizes ranging from 0.02 micron to 10 micron are preferred although many different types of porous membranes can be considered as long as they are either inherently wettable to the liquid used to create the falling film or can be surface modified to make them wettable. Membranes for consideration include but are not limited to nylon (polyamide-PA) membranes, polyethersulfone (PES) membranes, polysulfone (PS) membranes, polyvinylidene fluoride (PVDF) membranes, polyacrylonitrile (PAN) membranes, polypropylene (PP) membranes, polyethylene (PE) membranes, polytetrafluorethylene (PTFE) membranes, polycarbonate (PC) membranes, ethylene chlorotrifluoroethylene (ECTFE) membranes, and cellulosic membranes. Membranes can be naturally hydrophilic, as is the case with PA membranes, or can be surface modified to render them philic to a particular liquid. Many techniques for hydrophilization can be used including use of co-polymers and other additives in the polymer blend, coating of hydrophilic materials on the membrane, grafting of hydrophilic groups to the membrane surfaces using free radical polymerization techniques, radiation grafting, or plasma treatment techniques.

In particular, plasma treatment techniques that are generally useful in rendering porous materials hydrophilic are detailed in U.S. Pat. Nos. 6,878,419 and 7,125,603 assigned to 3M Innovative Properties Company and incorporated herein by reference. Specific techniques for plasma treatment of membranes as used herein include the following. A membrane, such as a nylon membrane, is treated under the following conditions, where flow rates and power are normalized to the electrode area: 0.5-100 wt-% silane in an optional inert gas (such as argon or nitrogen) at a gas flow rate in the range of 0.1 to 1.0 std·$cm^3/cm^2$; an oxygen gas flow rate in range of 0.01 to 0.1 std·$cm^3/cm^2$; a pressure in the range of 100 to 10,000 mTorr; a plasma power of in the range of 0.01 to 0.5 watts/$cm^2$; and a plasma treatment time in the range of 10 to 1000 seconds.

A specific set of conditions are: 2% silane in argon at a gas flow rate of 0.3 std·$cm^3/cm^2$; an oxygen gas flow rate of 0.04 std·$cm^3/cm^2$; a pressure of 990 mTorr; a plasma power of 0.08 watts/$cm^2$; and a plasma treatment time of 30 seconds.

Plasma treatment of a membrane with silane in the presence of oxygen results in a desiccant-wettable membrane whose surface is oxidized and comprises silicon oxides, silicon hydrides, and/or silicon hydroxides (Si—O—Si, Si—O—H and Si—H functional groups, identifiable by Secondary Ion Mass Spectrometry (SIMS)).

Exemplary cellulosic membranes include the following materials supplied by GE Whatman: a Mixed Cellulose Ester (ME 27), plain, 0.8 μm pore size and a Cellulose Acetate Membrane (ST 69), 1.2 μm pore size.

Fibrous Sheets

Wettable fibrous sheets facilitate formation of a falling film layer. Fibrous sheets are useful in the designs described herein because they may be provided with a substantially smooth surface.

Suitable fibrous sheets have multi- or dual scales, that is, they have porosity and/or channels in at least two different scales that are particularly useful. Two different scales provide, for example, that there are porous regions of the material created by the fibers in the layer that have pore sizes which aggressively wick the liquid desiccant into the pore structure due to high capillary force. The small pores may also retain liquid desiccant distributed over a portion of the void volume of the layer due to capillary forces even when the panel is mounted in a vertical orientation and the liquid desiccant is subject to the force of gravity. The second scale may be associated with larger connected pores or flow channels that are also distributed throughout the layer and allow a higher bulk flow of liquid desiccant in or on the layer when the panel is mounted in a vertical orientation. These connected pores or channels have lower capillary forces but allow higher lateral flow rates of the liquid desiccant within the layer. The flow within the connected pores or channels is created by the force of gravity. When liquid flow is stopped at the header, these larger connected pores or channels may drain until an equilibrium based upon the capillary length of the connected pore or channel is reached. Bulk liquid may be retained in the larger connected pores or channels in the bottom portion of the layer. Liquid may be retained and distributed throughout the layer in the smaller pores associated with the first scale. As the layer is already wet, liquid is also on the surfaces of the fiber. This insures uniform and controlled restart of liquid desiccant when flow is reintroduced through the header.

Figure 1A:
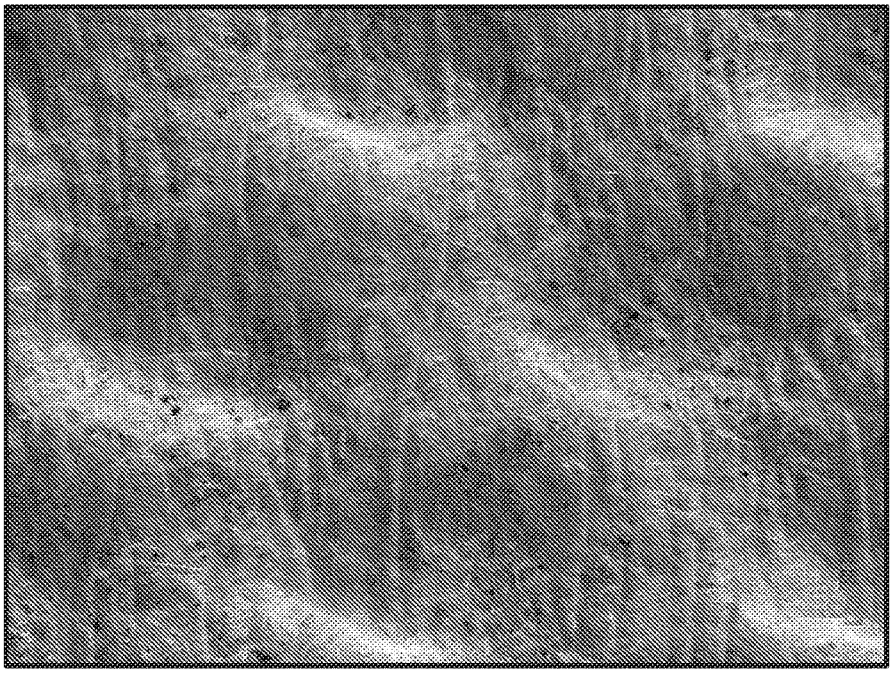
FIG. 1A is a microphotograph of an exemplary wettable layer comprising a fibrous sheet.
Figure 1B:
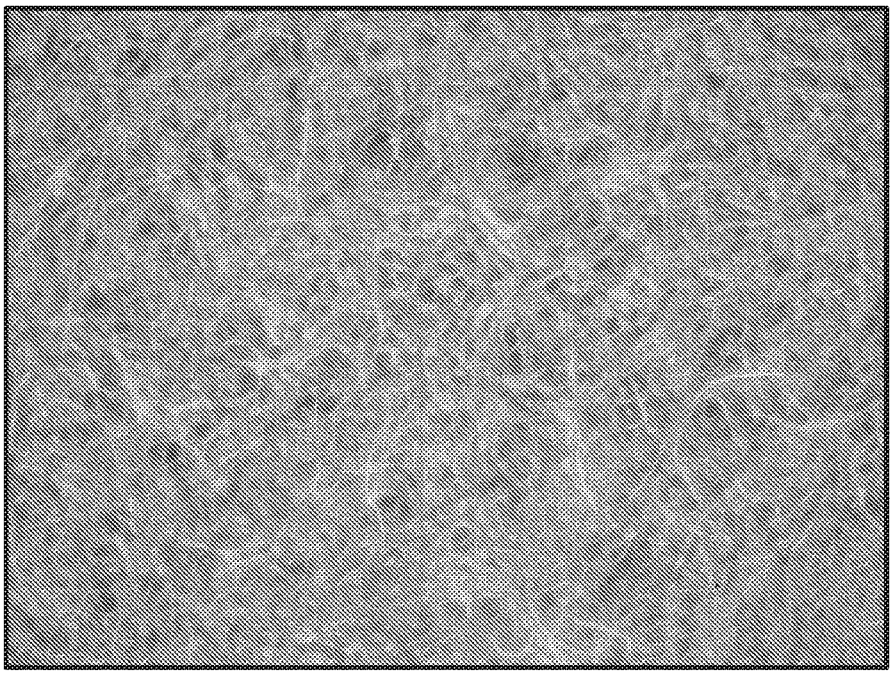
FIG. 1B is another microphotograph of another exemplary wettable layer comprising a fibrous sheet.
Figure 1C:
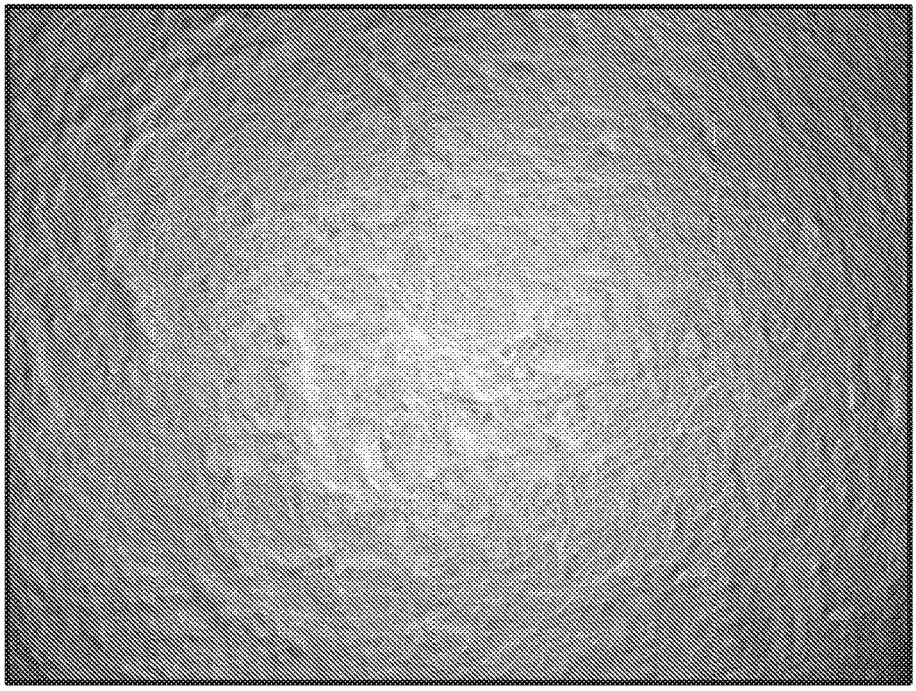
FIGS. 1C-1D provide further microphotographs at two different magnifications of a further exemplary wettable layer comprising a fibrous sheet.
Figure 1D:
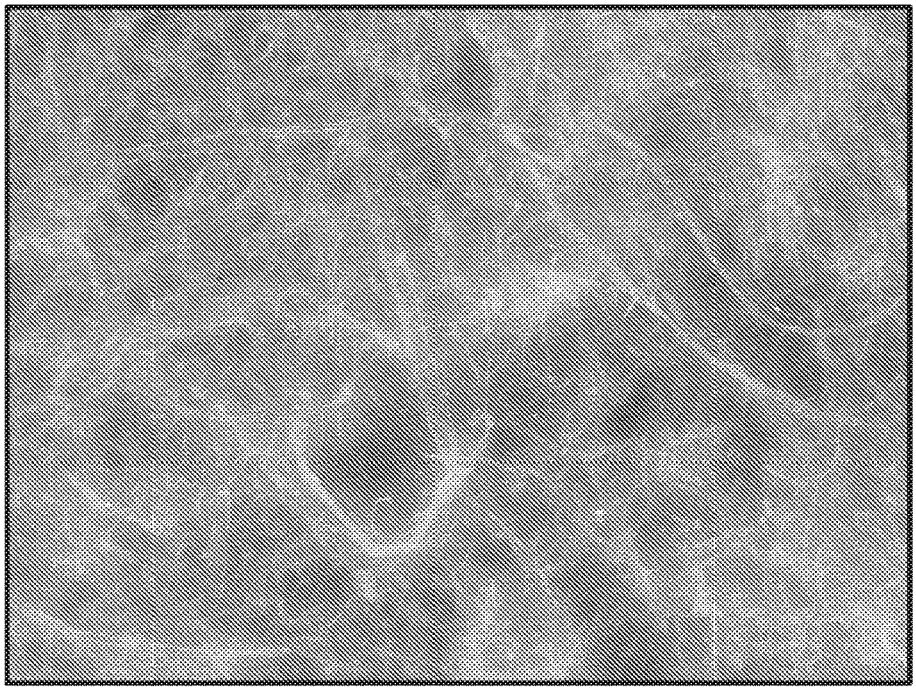
Figure 1E:
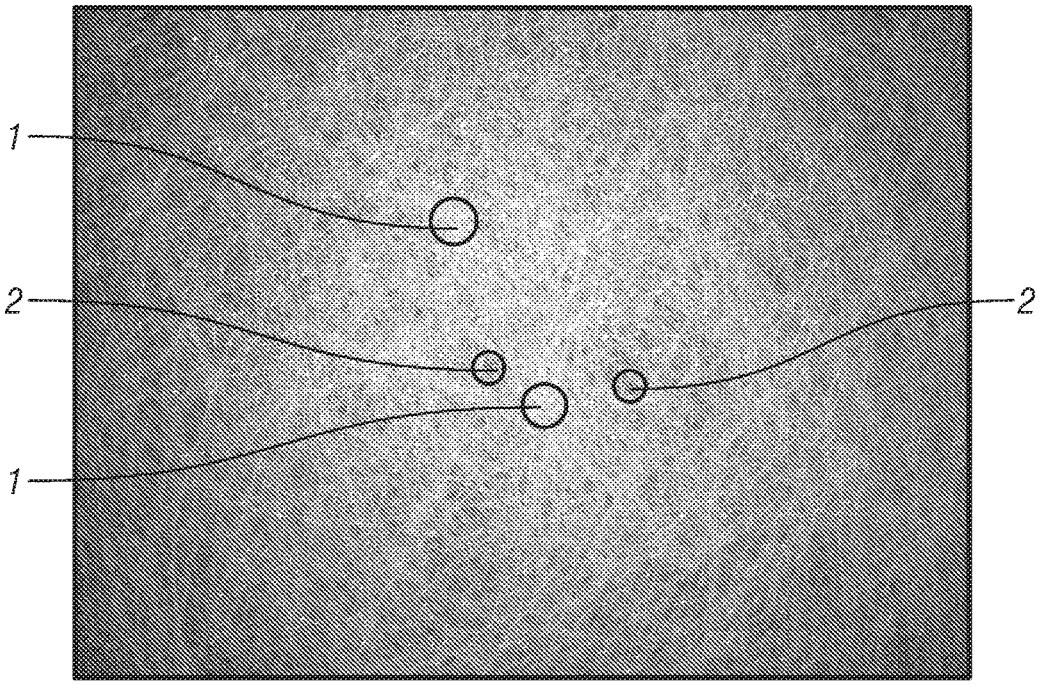
FIGS. 1E-F provide other microphotographs at two different magnifications of another exemplary wettable layer comprising a fibrous sheet.
Figure 1F:
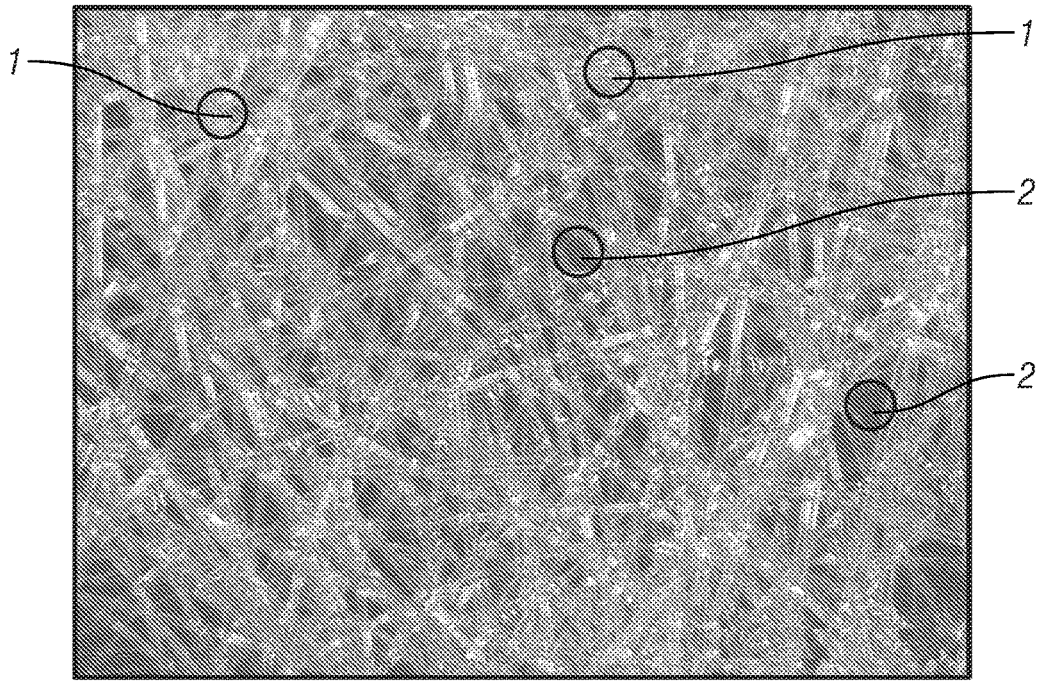
Figure 1G:
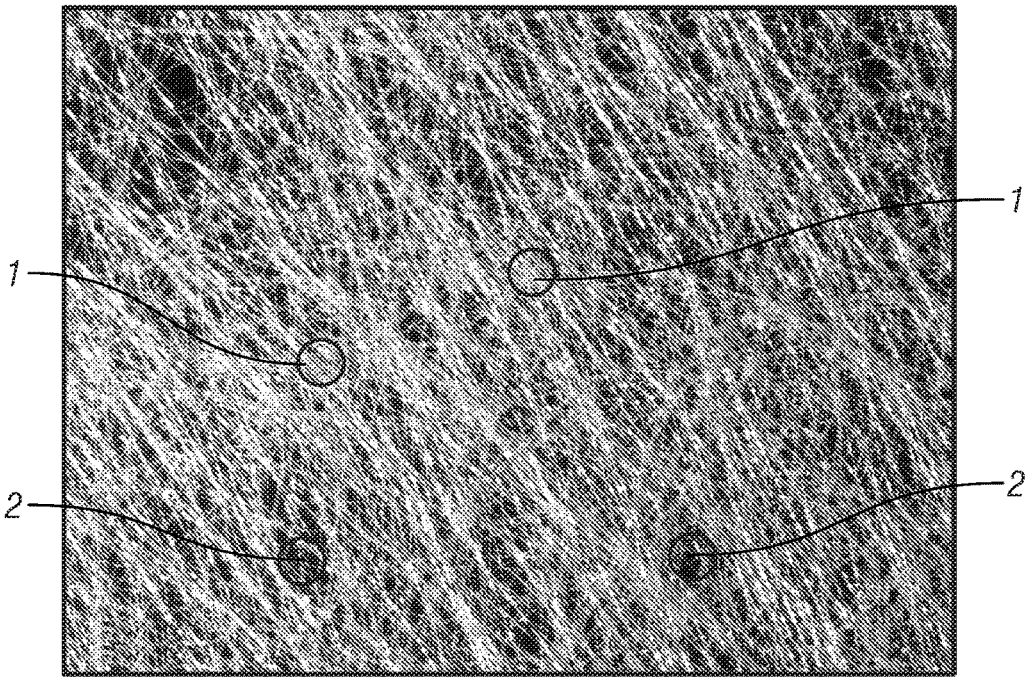
FIGS. 1G-H provide other microphotographs at two different magnifications of another exemplary wettable layer comprising a fibrous sheet.
Figure 1H:
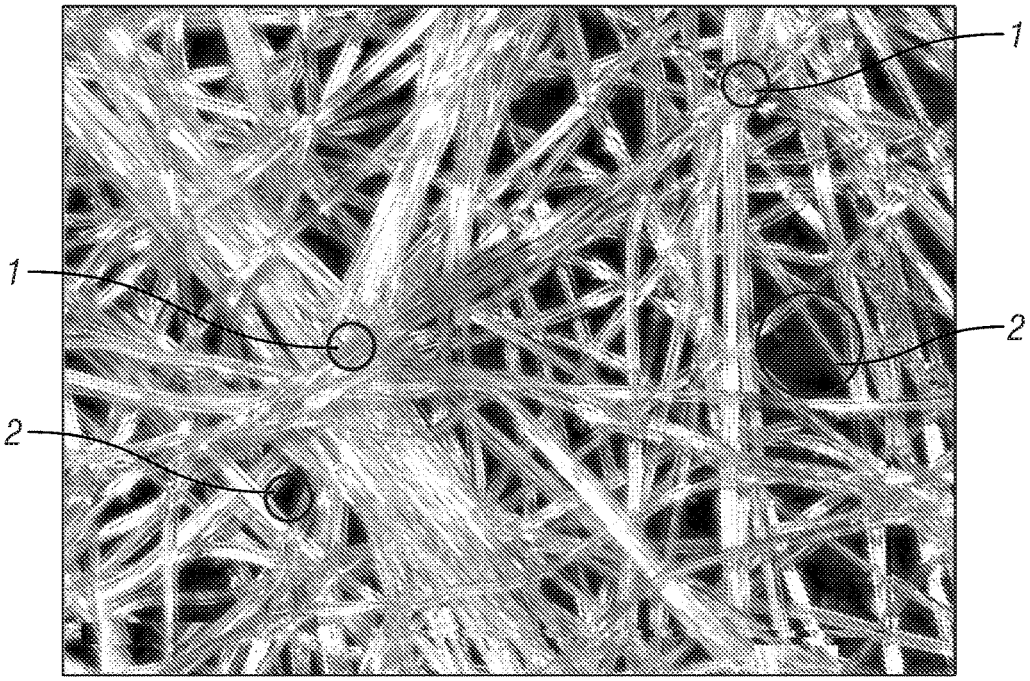

In FIG. 1A, a fibrous sheet comprising a dual scale has two different features: cellulose fibers forming the layer and embossing on the surface, resulting in different sizes and shapes. In FIG. 1B, a fibrous sheet comprising a dual scale has two different materials: cellulosic fibers and silica particles, resulting in different sizes and shapes. The material of FIG. 1B is TSM 600 supplied by 3M Purification Inc., which is a thin sheet media having a thickness in the range of 14.5-17.5 mils. Another suitable fibrous sheet is TSM 300, also supplied by 3M Purification Inc., which is also a thin sheet media having a thickness in the range of 14.5-17.5 mils. In FIGS. 1C-1D, a fibrous sheet comprising a multi-scale with three different features: glass fibers, cellulosic fibers, and surface topography resulting from vacuum formation, resulting in different sizes and shapes. The material of FIG. 1C (20 times magnification)-1D (200 times magnification) is 1MDS supplied by 3M Purification Inc., which is a thin sheet media having a thickness in the range of 17-23 mils. FIGS. 1E (20 times magnification)-1F (200 times magnification) and FIGS. 1G (20 times magnification)-1H (200 times magnification) all show a fibrous layer comprising a nonwoven material comprising continuous polyester fibers. Regions in the fibrous material can be seen where the spacing between the fibers is small creating pores of a first scale, for example, those areas labeled "1". Other regions in the fibrous material have large spacing between fibers on a second scale which allow higher bulk flow of the liquid in the layer, for example, those areas labeled "2". The two types of regions in the material thereby provide a multi scale layer. The material of FIGS. 1E-F is Reemay® 2214 Spunbond Polyester supplied by Fiberweb Technical Nonwovens. The material of FIGS. 1G-H is Reemay® 2011 Spunbond Polyester supplied by Fiberweb Technical Nonwovens. Spunbound polyester sheets may be used in one or more layers. Exemplary Reemay products that are suitable fibrous layers are as follows.

| Reemay ® Style | Filament Cross Section | Basis Weight (oz/yd$^2$) | Thickness (mils) | Frazier Air Perm (cfm/ft$^2$) | Textest Air Perm (cfm/ft$^2$) | Mullen Burst (psi) | Grab Tensile (MD/CD, lbf) | Trap Tear (MD/CD, lbf) |
|---|---|---|---|---|---|---|---|---|
| Remay 2011 | Trilobal | 0.75 | 9 | 1070 | 1112 | 16 | 14/11 | 5/6 |
| Remay 2014 | Trilobal | 1.00 | 9 | 880 | 870 | 22 | 21/17 | 6/7 |
| Remay 2250 | Round | 0.50 | 5 | 1080 | 1307 | 11 | 11/7 | 4/5 |
| Remay 2214 | Round | 1.35 | 9 | 521 | 518 | 28 | 32/30 | 9/10 |

It is also very useful for the material utilized in the fibrous sheet to have the fibers oriented in the plane of liquid flow, i.e. the fibers are substantially parallel to the plane of the support structure, and it is less useful for the fiber to be oriented substantially perpendicular to the plane of flow or the plane of the support structure. An interconnected network of fibers in the plane of flow minimizes the risk of carryover. Fluid can flow laterally in the layer along the fiber surfaces and on the layer (i.e. there can be a falling liquid film in and/or on the layer) and there are a minimal number of protrusions or fiber ends pointing out into the gas stream being treated. When a fiber points outward towards the gas stream, there is risk in liquid being detached from the end of a fiber and aerosolizing into the air stream resulting in desiccant carryover. The combination of fiber directionality in the plane of flow and the multi-scale morphology of the layer allows for higher flow capacity of the desiccant in and on the surface of the layer, uniform presentation of the liquid in and on the layer in relation to the gas stream to be treated, and minimized risk of carryover. A layer of this design will enable a panel to be run at a wider range of flow rates of the desiccant per unit face area of the layer than has been previously possible. This is particularly useful in a two fluid path (desiccant and air) panel design where higher desiccant flow rates may be required than in a three fluid path design. The ability of the layer to run at a wide range of flow rates per unit face area provides an additional desiccant control modality in the application of a heat and mass transfer panel. Both the desiccant temperature and the desiccant flow rate can be manipulated to influence the rate of heat and mass transfer. This is useful in the development of various control algorithms in a LDAC which needs to respond to a wide range of latent and sensible cooling demands.

Support Structures

The wettable layers are easily contacted with, mounted to, or affixed to support structures to maintain an orientation in a vertical position to receive the desiccant by gravity feed. The support structures are generally nonporous. Generally, the layers are in continuous contact with the support structures and not merely in contact at a plurality of locations. Support structures may be a frame or a plate. For a plate, continuous contact means the layer is in contact with all of the surface area of the plate. For a frame, continuous contact means that the periphery of the layer is in contact with all of the frame. With respect to contact, the layer may slip or slide on the support structure, but will generally be held against the support structure by surface tension. Some designs may attach the layer to the support at one location, for example along the top edge of both the layer and the support structure. Other designs may tack the layer to the support structure at various locations.

The support structures may be fabricated from materials suitable for the application. In an environment having a corrosive liquid desiccant a thermoset plastic, a thermoplastic, or a cellulosic material may be suitable. An exemplary plate is one formed from acrylic. Another exemplary plate is one that is a wax-coated cellulose. Yet another exemplary plate is one formed from a glass fabric and epoxy matrix (Norplex-Micarta). Plates or frames may be made from injection-molded thermoplastics, inj ection-molded thermoset plastics, or thermo-formed thermoplastics. Reaction injection molding can also be utilized to make support structures. Plates or frames may be shaped or stamped from flat stock materials, including but not limited to die-cutting or laser cutting from stocks of, for example, thermoplastic or thermoset sheets, cellulosic sheets, and/or reinforced paperboard sheets or chipboard. In the example of membranes directly formed on nonporous substrates, a nonporous film is a support structure, for example, a nonporous nylon film. In environments with non-corrosive or mild liquids, it is contemplated that metal or coated metal support structures would be suitable.

Some support structures in plate form may further comprise an internal fluid channel for a heat transfer fluid to provide the ability to regulate the temperature of the desiccant. Heat can then be exchanged with the wetted layer in contact with the surface of the plate. The plate can be internally cooled or heated. This can provide additional utility in the design of heat and mass exchangers and in particular in the design of LDAC heat and mass exchangers. The plates can be designed to meet particular applications. Flow channels for the heat transfer fluid may go cross-current, co-current, or in a variety of serpentine flows relative to the flow of the heat and mass transfer fluid falling on the face of the membrane. The plate can be formed from two or more components (i.e. two plates) which when bonded together form the flow channels for the heat transfer fluid. The plates can be made of various metals, plastics, or plastic composite materials. Metals may be coated to prevent corrosion. Examples of useful heat transfer fluids include water and various glycol solutions. The internal heat transfer fluid allows internal heating or cooling of the plate which in turn allows the heat and mass transfer fluid to be heated or cooled as it is falling within the membrane and on the face of the panel. This is particularly useful in LDAC applications as the ability of the liquid desiccant to absorb or desorb water is directly related to the temperature of the desiccant.

The wettable layer can be in direct and intimate contact with the surface of the heat exchanging plate, which can significantly improve the heat transfer between the heat transfer fluid (e.g. water) internal to the plate and the heat and mass transfer fluid (e.g. liquid desiccant) flowing in and on the membrane or fibrous sheet. Since the liquid is in the pores of the membrane or the fibers of the fibrous sheet and has some convective flow, heat transfer will be further improved.

The membranes can be attached to the plates in a variety of ways. Achieving contact of the layer with the support structure may be by surface tension between the wetted layer and structure or by virtue of pressure when assembling many heat and transfer components together. That is, the layer can be pre-wetted with desiccant and smoothed out onto the plate and surface tension will then hold it in place. Or, the layer may be affixed to the structure by an adhesive such as tape or glue. For example, a double sided adhesive tape can be used to attach the layer at the top of the support structure. Tape could be used throughout the whole plate and the membrane could be mounted and left dry. A variety of adhesives could be used to attach the membrane to the plate as long as the adhesive does not penetrate too far into the pores and/or affect the hydrophilicity of the layer. The layer could be heat bonded or ultrasonically welded to the plate at a series of points or in lines. One possibility is to weld in lines parallel to the desiccant flow direction at the correct intervals to create the phobic features that provide the lanes for desiccant flow. The layer could also be clipped or secured at the edges. Further the support structures could include channels that allow air to escape as the layer is wetted to prevent air entrapment and bubbling.

Channels may also be put into the support structure (i.e. support plate) to provide a second scale. The first scale is in the layer and the second scale allows channels for bulk flow behind the layer. Mixing occurs between the bulk flow going down the channels created between the layer and the support plate and the liquid desiccant moving more slowly downward in the pores of the layer which are of the first scale.

Components

Heat and mass transfer components are formed from any wettable layer disclosed herein in combination with any support structure. An exemplary heat and mass transfer component 100 is shown in FIG. 1 where a wettable layer 104 having an inlet end 108 and an outlet end 106 is in contact with a support structure in the form of a plate 102, which optionally has one or more internal fluid channels 103 for a heat transfer fluid. Draw-and-drip features 105 are located at the outlet end 106.

Figure 2:
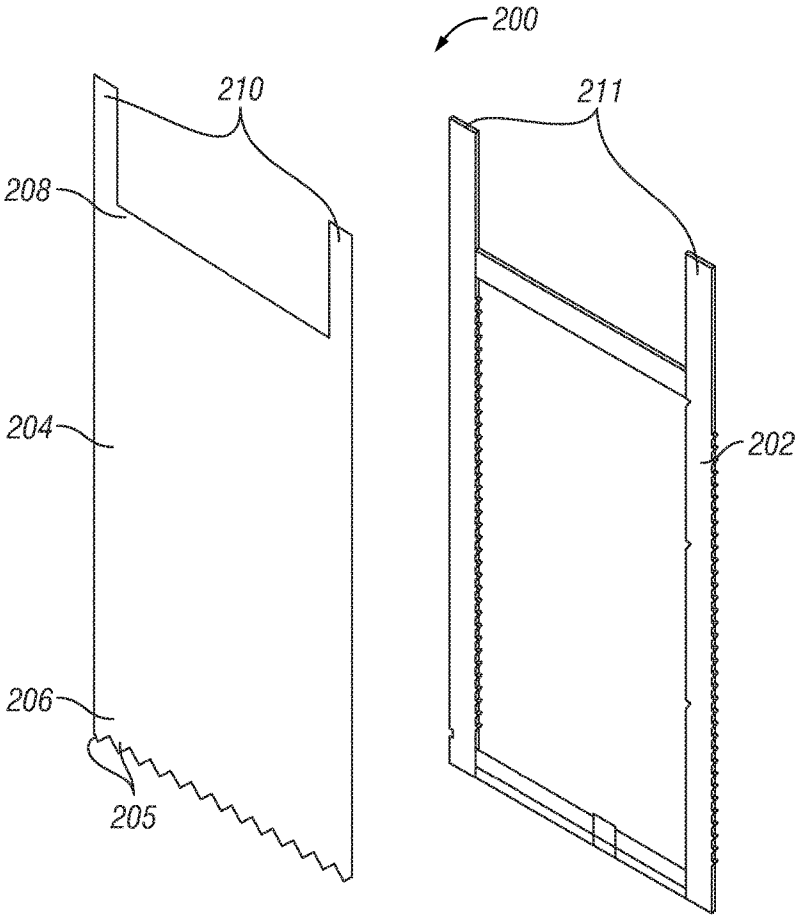
FIG. 2 is a perspective exploded schematic of another exemplary heat and mass transfer component.

Another exemplary heat and mass transfer component 200 is shown in FIG. 2 where a wettable layer 204 having an inlet end 208 and an outlet end 206 when assembled is in contact with a support structure in the form of a frame 202. Draw-and-drip features 205 are located at the outlet end 206. The wettable layer may comprise one or more assembly features 210 that facilitate assembly of the layer with the support structure. Likewise, the support structure, in this embodiment, the frame 202, may also comprise one or more assembly features 211 that facilitate assembly of the support structure the layer and other heat and mass transfer components. One advantage of the framed design is that the amount of layer required is cut in half resulting in a major cost savings over panels which utilize only one side of the layer to control the desiccant film. A second advantage is that the frame can be made out of very thin materials which also reduces cost and improves compactness of a module made from the panels. Compact modules have an inherently higher power density which is an advantage in LDAC systems. This panel design is also suitable for manufacture utilizing high volume automated assembly operations.

Panels

Figure 3:
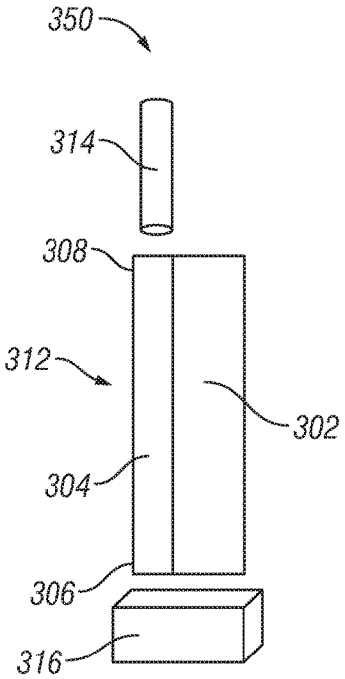
FIG. 3 is a side view of an exemplary heat and mass transfer panel.

Heat and mass transfer panels are formed from any heat and mass transfer components disclosed herein in conjunction with a fluid distribution system. Panels can be assembled using adhesives, plastic welding (thermal and ultrasonic), or snap together designs. A gas contact zone is adjacent to the layer of the heat and mass transfer component. In FIG. 3, an exemplary heat and mass transfer panel 350 comprises a wettable layer 304 in contact with a support structure 302, and a gas contact zone 312 is adjacent to the layer 304. In this embodiment, the fluid distribution system comprises a manifold 314 for supplying fluid to the inlet end 308 of the layer 304 and an optional fluid collection system comprises a vessel 316 that is in fluid communication with the layer 304.

A fluid distribution system supplies the liquid desiccant to the layer for generating a falling film. The fluid distribution system enables the creation of an upper liquid seal, which then permits panels to be stackable. The upper liquid seal prevents crossover between the air and the desiccant when used in a stacked configuration. The air and the desiccant are in a cross-current flow. This design significantly minimizes or eliminates carryover of the heat and mass transfer fluid into the air/gas stream which is particularly important in LDAC applications using corrosive liquid desiccants. The prior art uses spray bars and wicking pads to manage the desiccant flow and this creates problems with significant aerosolization and thus carryover of the desiccant into the air stream. Pieces of the fluid distribution system may be rendered hydrophobic to facilitate disengagement of the desiccant from the system onto the layer. An exemplary superhydrophobic coating may be formed by treating a fluid release surface with a product such as Rustoleum Never-Wet®. Surfaces coated with this material will not wet with 35% LiCl solution so they are desiccant phobic. Fluid distribution systems may be discrete structures that are located in fluid communication with the membrane. Such discrete structures that are physically separate from the panel may include, but are not limited to manifolds made from a single pipe with a series of holes to deliver the fluid. Fluid distribution systems may also be formed by one or a combination of individual pieces, which are included in the panel designs. For example, a header may be associated with a layer/support structure component, and the header functions to deliver fluid to the layer. An assembly of layer/support structure components may result in a plurality of headers, which in combination can form the fluid distribution system.

Figure 4:
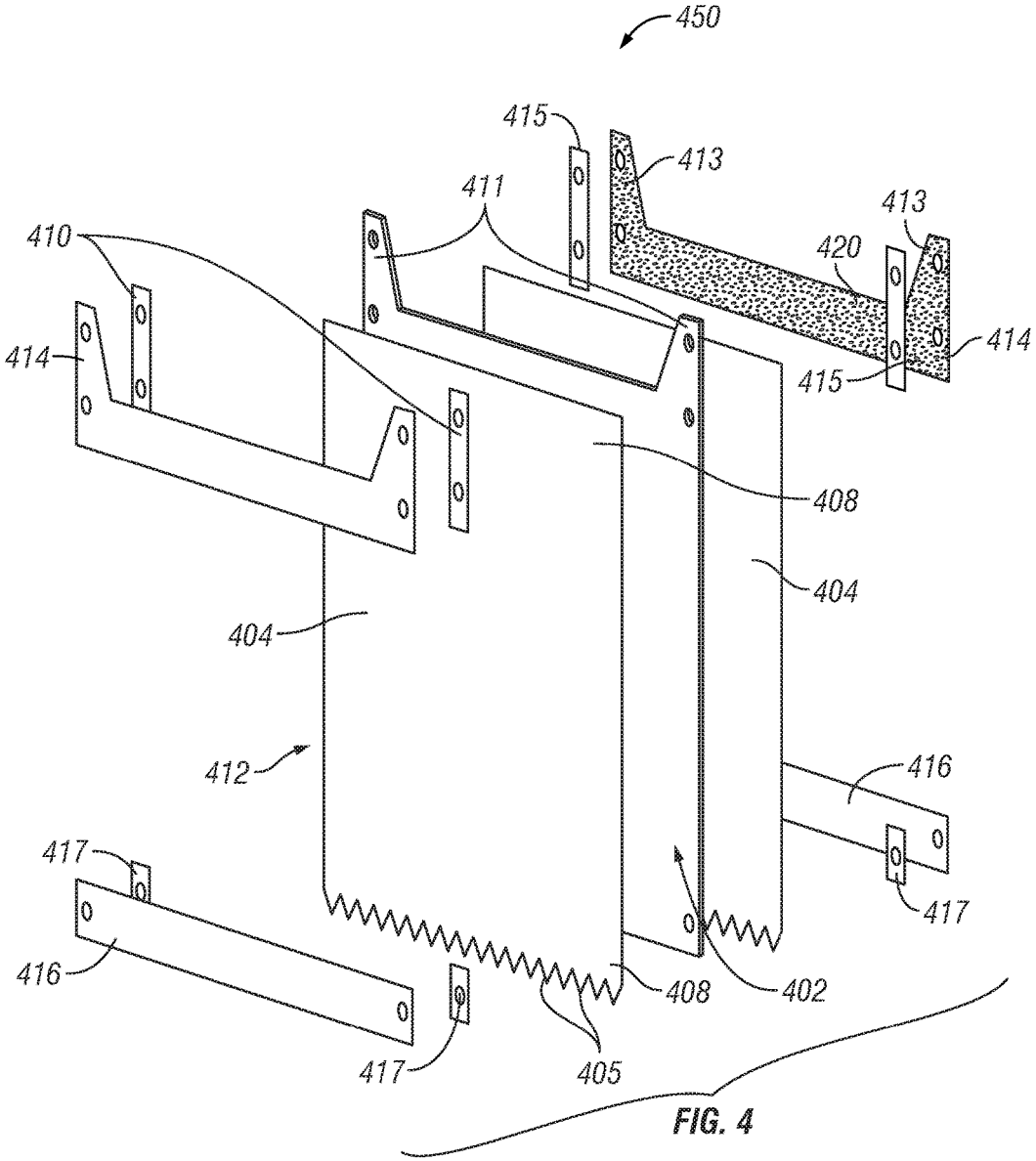
FIG. 4 is a perspective exploded schematic of another exemplary heat and mass transfer panel.

FIG. 4 provides another an exemplary heat and mass transfer panel 450 comprising two wettable layers 404, each having draw-and-drip features 405, a support structure 402, and a gas contact zone 412 that is adjacent to the layers 404 on the surface opposite the support structure 402. Optional shims 410 are provided for affixing the layer 404 to a header 414. In this embodiment, the fluid distribution system comprises the header 414 for supplying fluid to the inlet end 408 of the layer 404 and the fluid collection system comprises a footer 416 that is in fluid communication with the layer 404. Desiccant flow features 420 are provided in the surface of the header 414. Optional assembly features 411, 413 are provided with the support structure 402, and the header 414 respectively. Spacers 417 may be added to set the spacing between pieces at the outlet end 406 and shims 415 may be added to set the spacing between pieces at the inlet end 408.

A panel made from the wettable layer can be run at different flow rates based upon the design of a flow gap (i.e. gap width, gap height, gap geometry) resulting from the header design and the amount of liquid head applied at the top of the panel. Viscosity of the desiccant will also impact its flow rate. In cases where the liquid flow is low, there will be a fewer number of ribbons of film on the surface of the layer. As flow rates are increased, the layer coverage will increase. It is also possible to intermittently supply desiccant to the layer surface. The layer will still function as a heat and mass transfer surface as the periodic replenishment and exchange of fresh desiccant will enable the temperature and concentration of the desiccant to be controlled. An advantage of the wettable layer design is the ability to run a panel utilizing this component at a wide range of continuous desiccant flow rates or using an intermittent flow. Panels or modules using the wettable layer component can be easily controlled by manipulating the desiccant flow rate and desiccant temperature.

Figure 5:
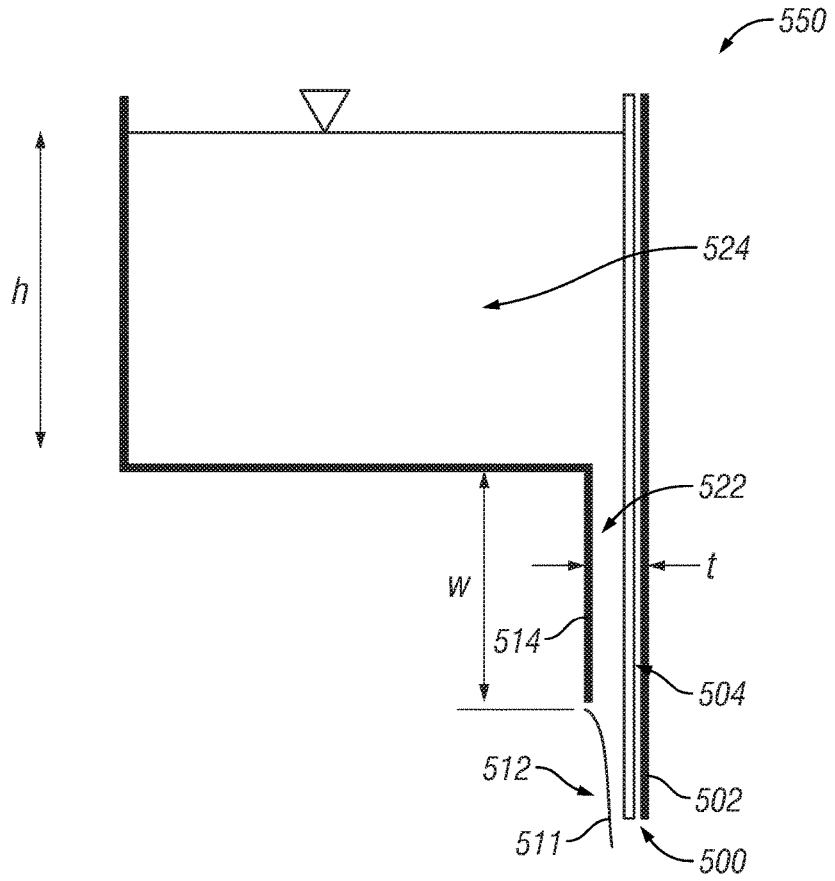
FIG. 5 is a schematic side view of header geometry.
Figure 5A:
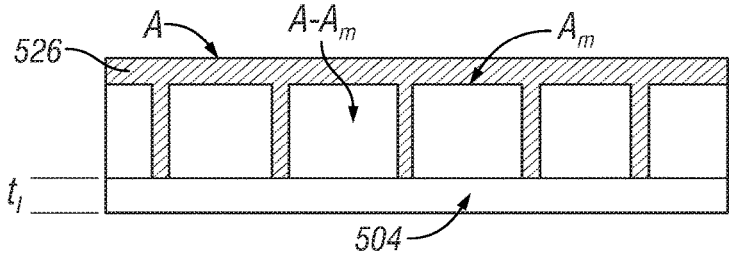
FIG. 5A is a schematic of the layer material and effective gap thickness.
Figure 21:
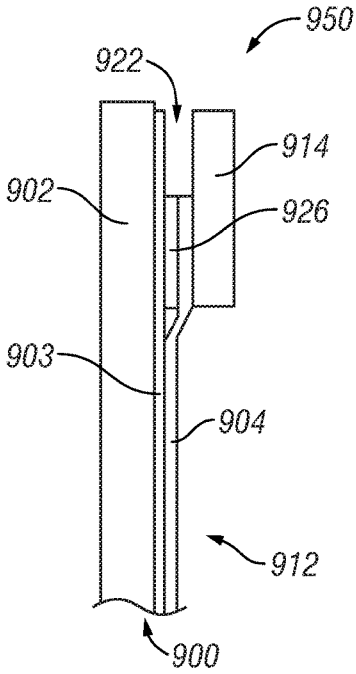
FIG. 21 is a schematic side view of an exemplary header geometry.

Flow gap width, height, and geometry impact desiccant flow and distribution and overall uniformity of flow. The header gap 522 geometry is characterized by its thickness t, length w, a discrete, wettable layer 504 in the gap as shown in FIG. 5, and optionally any additional geometry 526 present in the gap as shown in FIG. 5A. In FIG. 5, a partial heat and mass transfer panel 550 having a heat and mass transfer component 500 comprises a support structure 502 and a discrete, wettable layer 504 along with a gas contact zone 512 and a header 514. Falling film 511 is formed from desiccant supplied from a liquid reservoir 524 formed by header portions of a plurality of heat and mass transfer panels. t, measured from the support structure surface to the header 514 includes the layer 504, and greatly affects the desiccant flow rate. Precise control of the gap is desirable. Control of the gap size can be achieved by providing a well-defined gap material 526 (e.g. 10 mil Delnet) as shown in FIG. 5A in the gap along with the layer or by incorporating features on the header assembly which create geometry in the gap (i.e. are molded or formed directly on the components of the header) or by a gap which is merely an open slot in conjunction with the layer. In FIG. 21, a partial heat and mass transfer panel 950 having a heat and mass transfer component 900 comprises a support structure 902 and discrete, first and second wettable layers 903 and 904 along with a gas contact zone 912 and a header 914, which for this embodiment is a gap forming plate. Desiccant is supplied into header gap 922. A gap material 926 (e.g. 10 mil Delnet) is located in the gap 922 between the wettable layers 903, 904. For the case when additional geometry is created in the gap, an effective gap, $t_e$ can be defined as: $t_e=(A-A_m)/W$, where A is the total cross sectional area of the gap which includes the layer, $A_m$ is the cross-sectional area of the additional geometry, W is the width of the header, and $t_l$ the thickness of the discrete layer as shown in FIG. 5A, which is a top view of header geometry for a heat and mass transfer panel.

The magnitude oft (or $t_e$) for a two-fluid module design is expected to be generally between 0.003"-0.040," preferably between 0.006"-0.031" with a tolerance of about ±0.002", preferably ±0.001". For a three-fluid module, t could be as low as ti, i.e. the desiccant flows only through the layer.

The layer is also located within the gap. The effective thickness of the gap and the layer interact to provide a flux (liquid flow rate per open cross sectional area of the gap=$A-A_m$) through the gap in a range that is useful for liquid desiccant air conditioning applications. The fluid flows both through the open area of the gap and also laterally through the layer as it exits the gap. The face width is defined as the width of the discrete layer on the support structure that is carrying the liquid desiccant in and on the layer. For a two-fluid path module the useful flow rate is typically in the range of 0.5 to 20 ml/min per inch of width. For a three-fluid path module, due to the internal heat exchange in the module between the third heat exchange fluid and the liquid desiccant, the useful flow rate range is an order of magnitude lower and is typically in the range of 0.05 to 2.0 ml/min per inch of width.

Additional optional features of the panel include desiccant flow features as part of the fluid distribution system. Such features are located between components, and they facilitate distribution of substantially uniform flow onto the face of the layer. Such features may be directly embossed, compression stamped, or molded into the header components. The desiccant flow features may be integral to the support structure or may be discrete pieces located between adjacent panels. When the desiccant flow features are integral to the support structure, they may be designed into an injection mold, which provides predictable geometries and tolerances.

Discrete desiccant flow features may include, but are not limited to a polymeric material that comprises an extruded web material, an apertured polymeric film, an open cell foam, a porous nonwoven material, a woven material, or combinations thereof. An exemplary apertured polymeric film is 10 mil polypropylene Delnet, which is useful in creating longitudinal desiccant flow channels onto the layer. An exemplary extruded web is 30 mil polypropylene Naltex (nettings), where the structure of this material assists in spreading the desiccant onto the layer.

A fluid collection system directs the desiccant off of the layer for further handling. The fluid collection system enables the creation of a lower fluid seal, which, like the fluid distribution system, permits panels to be stackable. The lower liquid seal prevents crossover between the air and the desiccant when used in a stacked configuration. The air and the desiccant are in a cross-current flow. Fluid collection systems may be discrete structures that are located in fluid communication with the layer. Such discrete structures that are physically separate from the panel may include, but are not limited to piping/tubing or storage tanks. Fluid collection systems may also be formed by one or a combination of individual pieces, which are included in the panel designs. For example, a footer may be associated with a layer/support structure component, and the footer functions to direct fluid away from the layer. An assembly of layer/support structure components may result in a plurality of footers, which in combination can form the fluid collection system. Footer flow channel features can be directly embossed, compression stamped, or molded into footer components.

The footer may have a stepped design that has a wide area where the falling liquid film initially enters the footer and there is an air gap between the film and a face of the footer. A reservoir may be defined by the footer and the layer at the outlet end. The wide area is then stepped down to a collection gap thickness that is very close to the mean thickness of the falling film. The collection gap thickness is maintained using shims or stand-off features in the same manner as the flow gap resulting from the header design. The actual film is wavy and the thickness of the film varies or oscillates as it falls. This stepped footer design allows the liquid to build-up slightly in the wide area and then drain out as the head pressure builds and increases the flow through the collection gap. In addition, the drip and draw features on the layer may be located below the footer and further work to increase the velocity of the falling liquid and "pull" it through the collection gap and off the layer. This footer design manages the flow of the liquid off of the layer while sealing the air treatment side of the system from the liquid collection and removal portion of the system. The footers prevent any liquid accumulation or liquid splashing that could lead to desiccant carryover. In addition, the footers permit the flushing of any potential debris that ends up in the desiccant. The plates are stackable in a manner which allows successive footers to mate face-to-face and thus provide a series of liquid/air seals.

Figure 6:
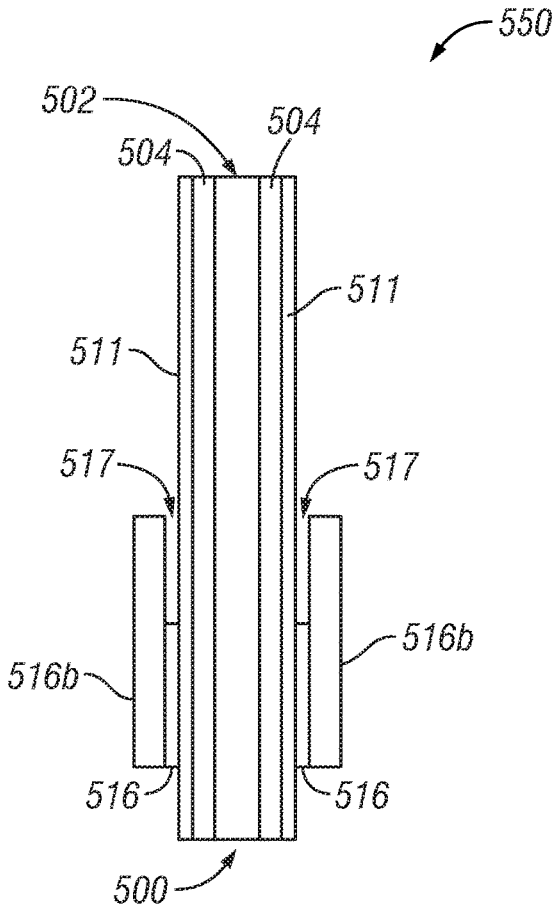
FIG. 6 is schematic side view of footer geometry.

In FIG. 6, which shows a partial heat and mass transfer panel 550 and component 500, an exemplary footer 516 is depicted, having wettable layers 504 and resulting falling films 511 on both sides of the support structure 502. The footer 516 further comprises a stepped portion 516*b* to define a gap 517.

Non-uniformity in fluid flow can present air leakage out of the module when under positive pressure or air leakage into the module when under negative pressure. Having effective fluid distribution (header) and collection (footer) systems minimizes any air leakage. Leakage of air results in energy loss and overall inefficiencies in operation of heat and mass transfer systems. Effective liquid seals accommodate various supplies of air. For example, air may be supplied by a fan pushing air into the cross-flow area where the air contacts the desiccant, resulting in a positive pressure in the area. Or, air may be supplied by a fan pulling air out of the cross-flow area where the air contacts the desiccant, resulting in a negative pressure in the area.

Modules

Heat and mass transfer modules may comprise one or more support structures; a gas contact zone adjacent to the support structures; a fluid distribution system comprising one or more headers that define a fluid reservoir; and a fluid collection system comprising one or more footers having a stepped feature; and at least one end plate. Modules may be constructed of any desired dimensions to meet requirements of specific applications.

Heat and mass transfer modules may also be formed from any heat and mass transfer panels disclosed herein in conjunction with at least one end plate. Typically, a plurality of panels is provided between two end plates. Assembly of panels into a module introduces gaps between the panels, which are desirably held at substantially uniform distances from each other in order to control an air contact zone. That is, the gaps between the panels (flow gaps at the inlet end and collection gaps as the outlet end) are desirably substantially uniform. The gaps are substantially uniform along an entire inlet edge of the panels as well as relative to each other. Uniformity of air flow is desired.

As panels are assembled together, an upper reservoir is created to feed in the desiccant over many panels. One common liquid head then supplies liquid desiccant and every panel is subject to the same head pressure denoted as "h" and shown in FIG. 5. Thus, each wettable layer is in fluid communication with all of the fluid distribution systems.

In the fluid distribution system, shims may be provided in order to achieve substantially uniform air gaps. Similarly, in the fluid collection system, shims may be provided in order to achieve substantially uniform air gaps. Generally, the smaller the air gap the better. In one or more embodiments, the gap is about ⅛".

Figure 7:
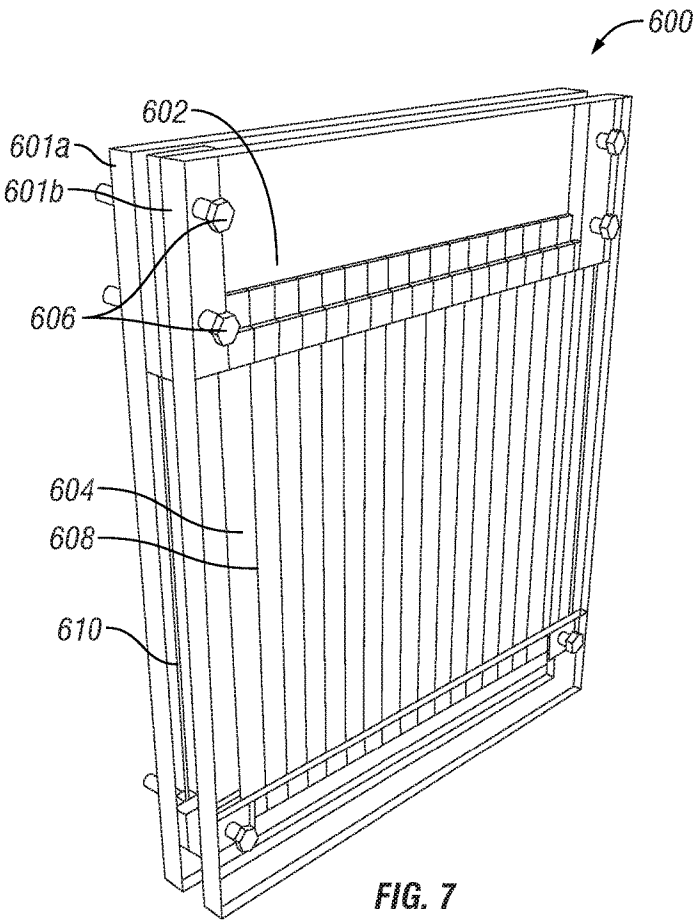
FIG. 7 is a perspective view of a portion of an exemplary heat and mass transfer module.

FIG. 7 provides a perspective view of a portion of an exemplary heat and mass transfer module 600 comprising end plates 601*a* and 601*b* that house a support structure 602 that is in contact with wettable layer 604 and that are attached together by mechanical fasteners 606. The wettable layer 604 comprises phobic stripes that form channels 608. A fluid distribution system and a fluid collection system are added to the embodiment of FIG. 7 as disclosed herein and exemplified in FIGS. 5 and 6 respectively. Air inlet opening 610 supplies air in a cross-flow to the desiccant flow.

Figure 8:
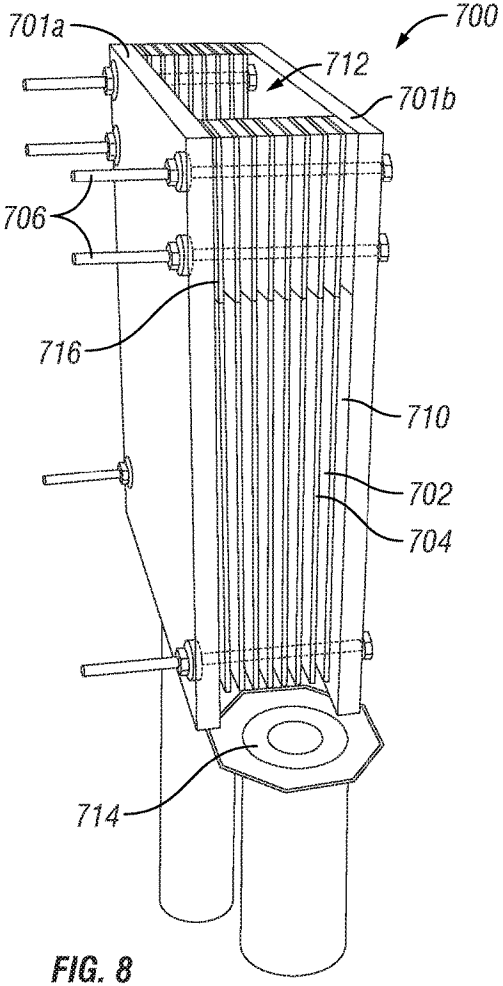
FIG. 8 is a side view of an exemplary heat and mass transfer module.

FIG. 8 is a side view of an exemplary heat and mass transfer module 700 comprising end plates 701*a* and 701*b* that house a plurality of support structures 702 each of which is in contact with a wettable layer 704. A fluid distribution system in the form of a reservoir 712 for supplying the desiccant is formed by combining headers support structures in a regular pattern. Spacers 716 are located between support structures 703. A fluid collection system in the form of a fluid collection pan 714 receives desiccant. Air inlet opening 710 supplies air in a cross-flow to the desiccant flow. Air outlet opening is at the opposite end of the panel from the air inlet opening.

Figure 9:
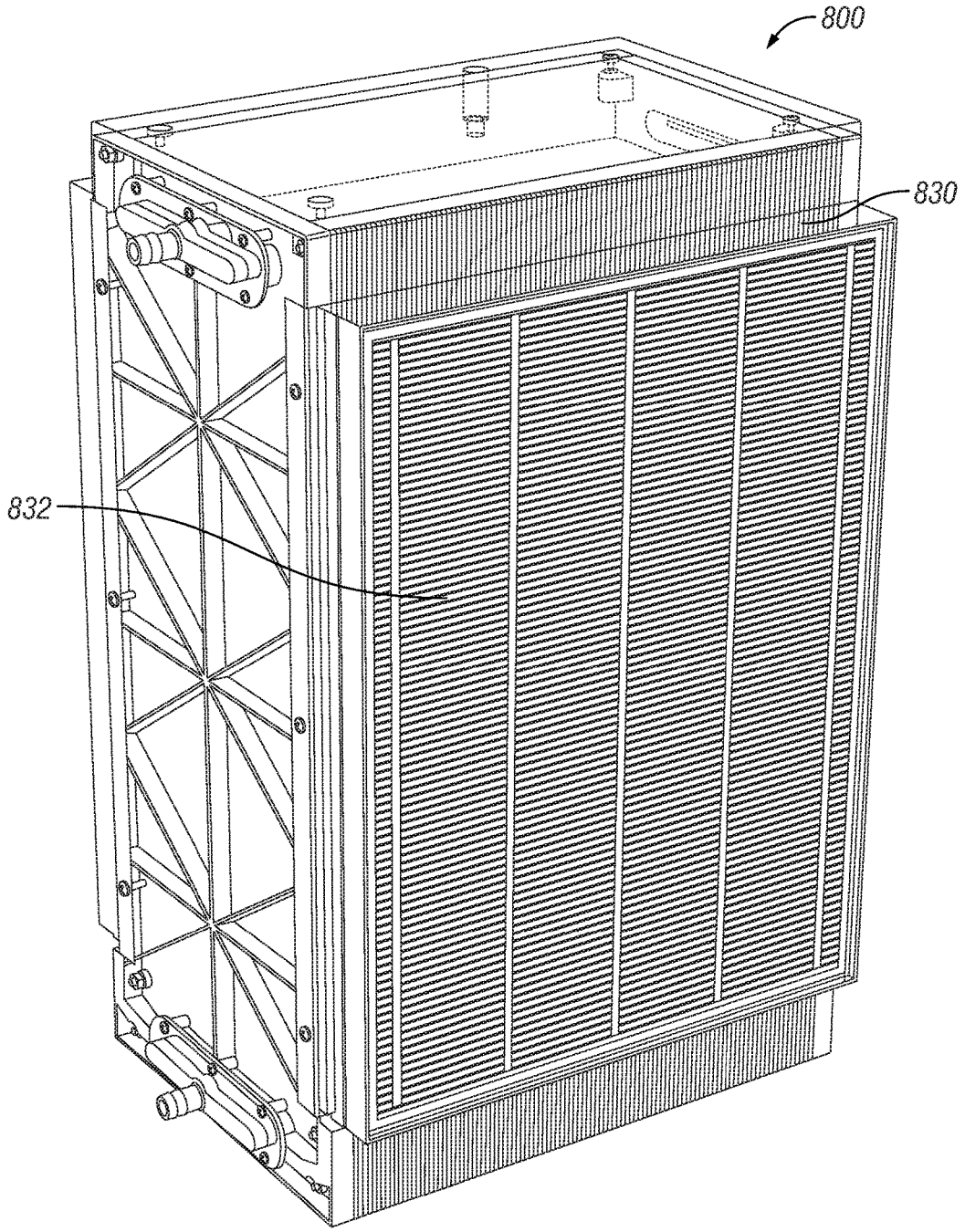
FIG. 9 is a schematic of another exemplary heat and mass transfer module.

Optionally, air filters may be provided upstream of the module's air inlet opening and/or downstream of the air outlet opening. FIG. 9 is a schematic of another exemplary heat and mass transfer module 800 comprising a housing 830 and a first air filter 832. Air from the first air filter then enters the air inlet opening of the module. Air exiting from the air outlet opening of the module may then enter a second air filter, which is on the opposite side of the housing 830 from the first air filter. An exemplary first air filter, or pre-filter, is a MERV A8 filter supplied by 3M Purification Inc., which is a mini-pleat type filter comprising 100% synthetic media that is moisture and humidity resistant and is 100% metal free. An exemplary second air filter, or final filter, is a MERVA13 filter, supplied by 3M Purification Inc., which is effective for removal of dust, lint, pollens, spores and many other common particulate contaminants. The filters in combination with the module would provide high levels of particle removal and improved indoor air quality in addition to the dehumidification performance. The MERVA13 electret filter downstream of the air exiting the air outlet opening of the module would provide redundancy in capture of any aerosolized desiccant in case of malfunction of the module. Both filters have very low pressure drops for their level of particle removal efficiency due to the electret technology and this in combination with the low pressure drop design of the heat and mass transfer module minimizes the fan power required to move air through the module.

Systems

Figure 10:
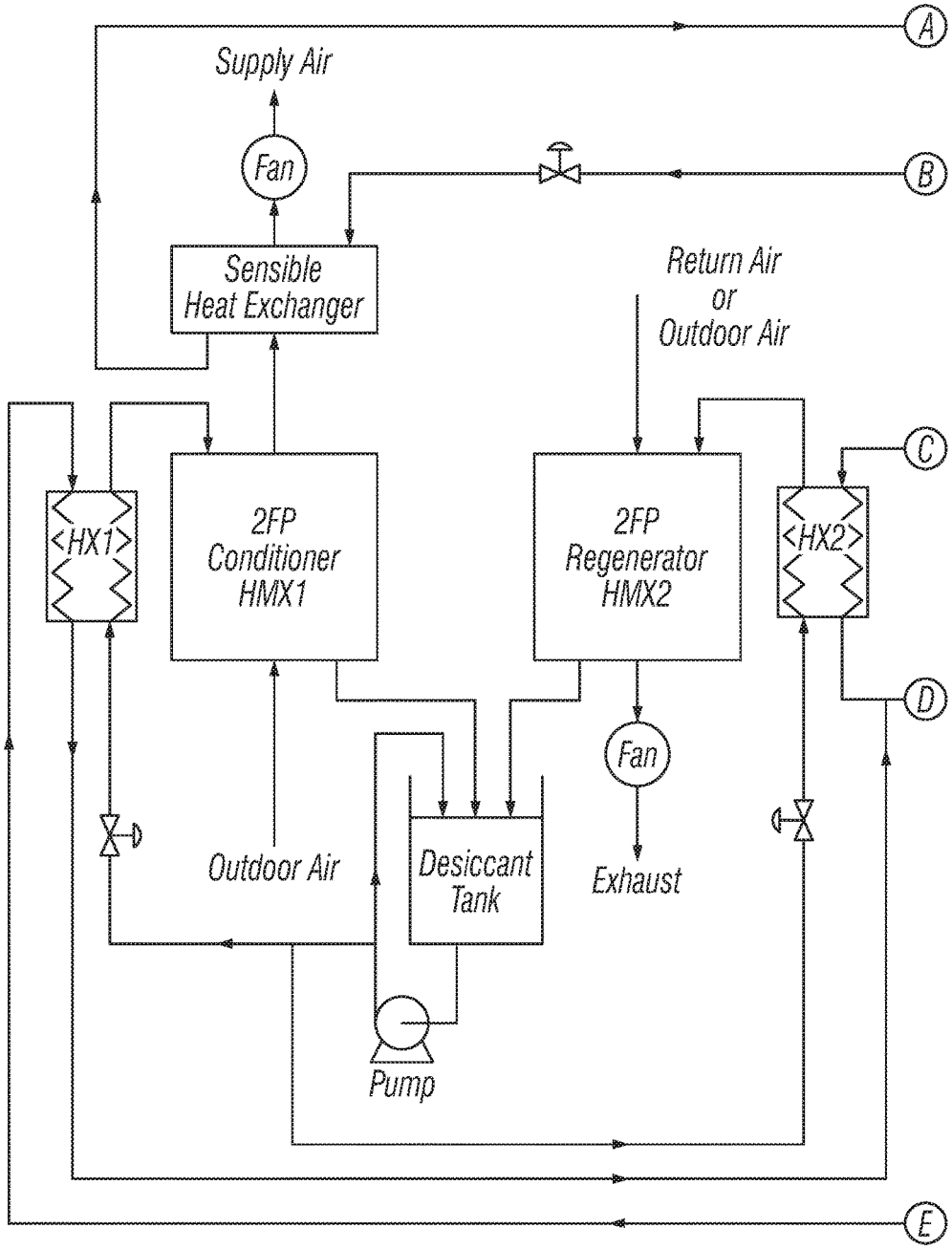
FIG. 10 is a schematic of an exemplary heat and mass transfer LDAC system using a first two-fluid path heat and mass transfer module for conditioning and a second two-fluid path heat and mass transfer module for regenerating.
Figure 10:
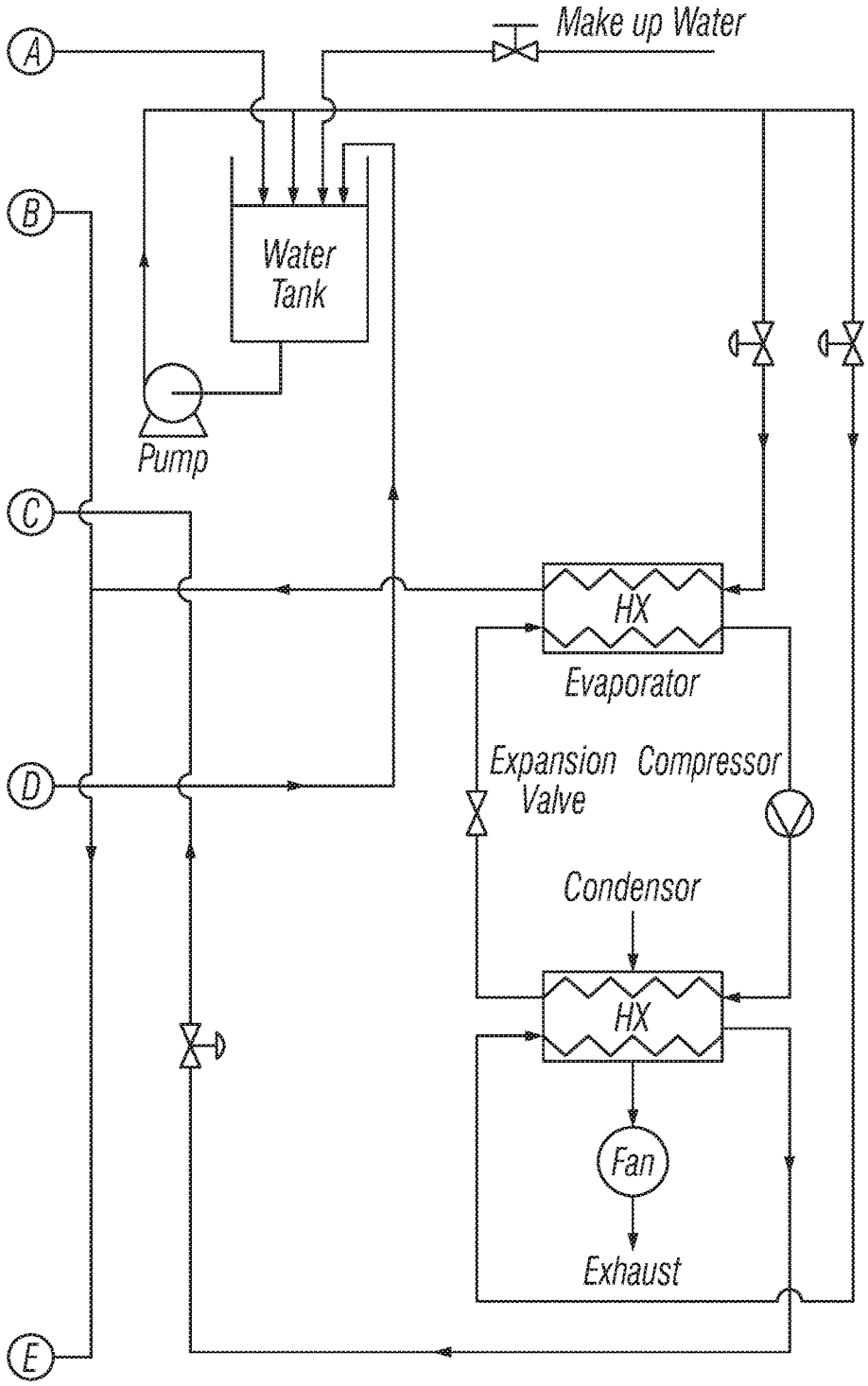
Figure 11:
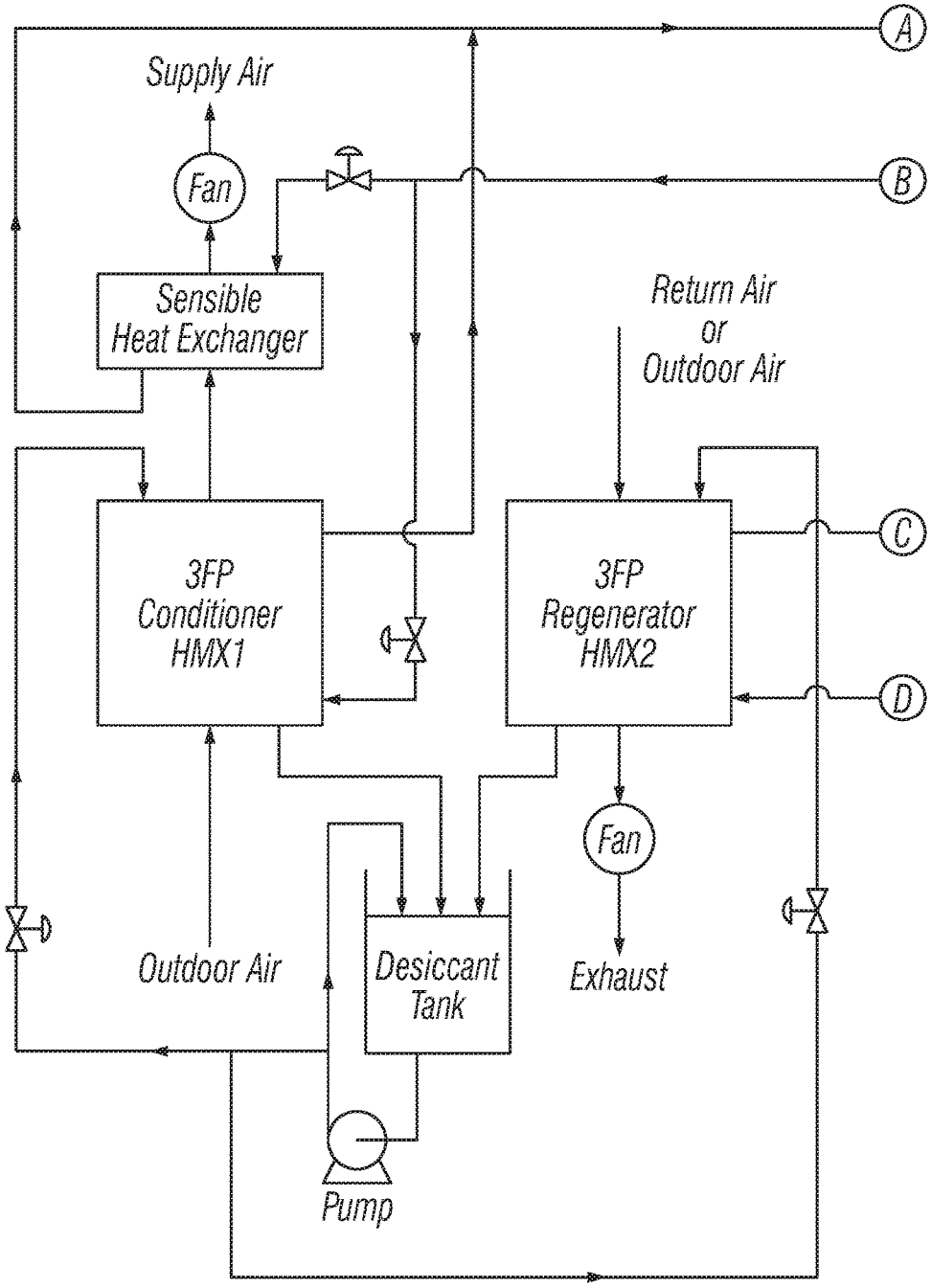
FIG. 11 is a schematic of an exemplary heat and mass transfer LDAC system using a first three-fluid path heat and mass transfer module for conditioning and a second three-fluid path heat and mass transfer module for regenerating.
Figure 11:
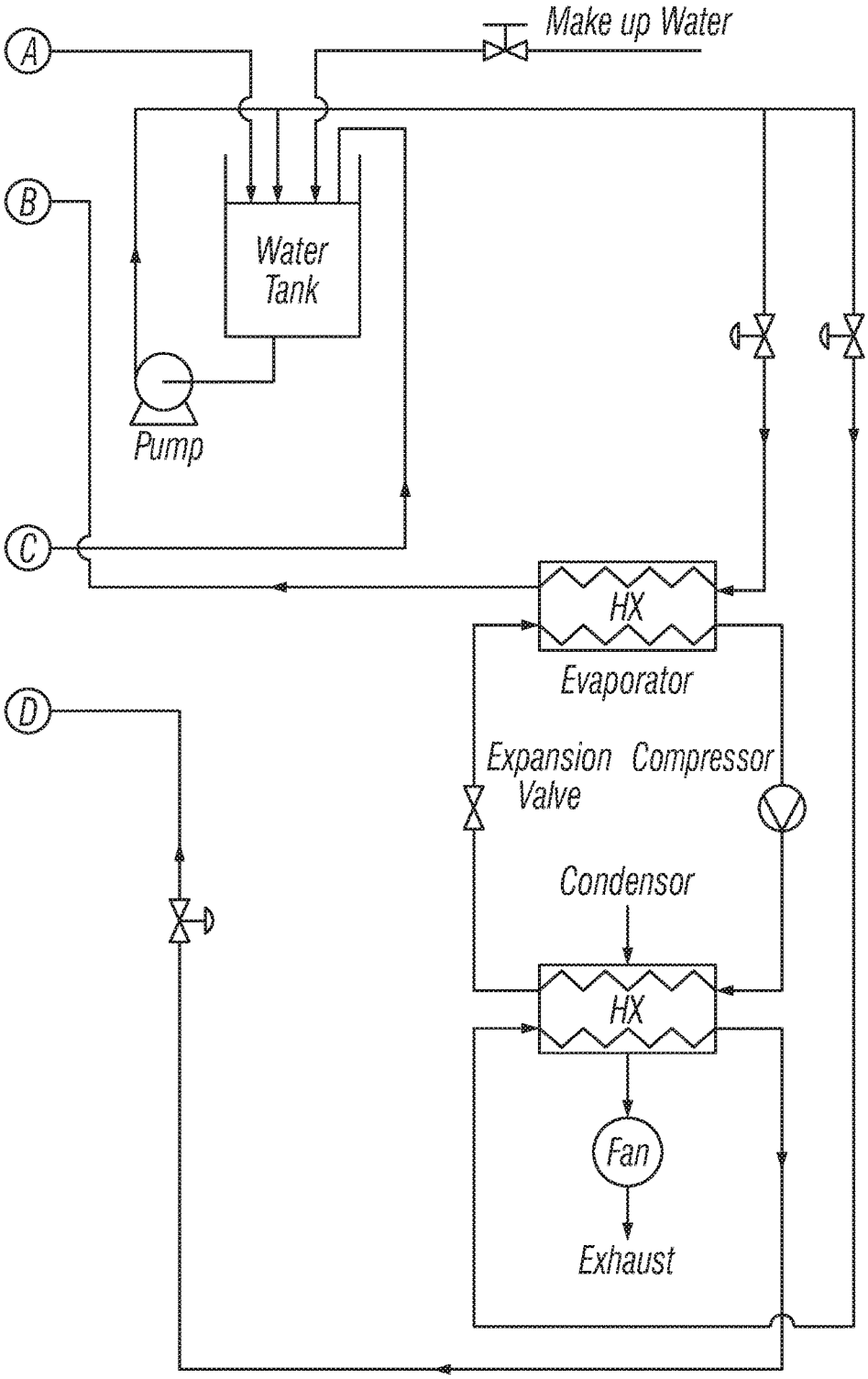
Figure 12:
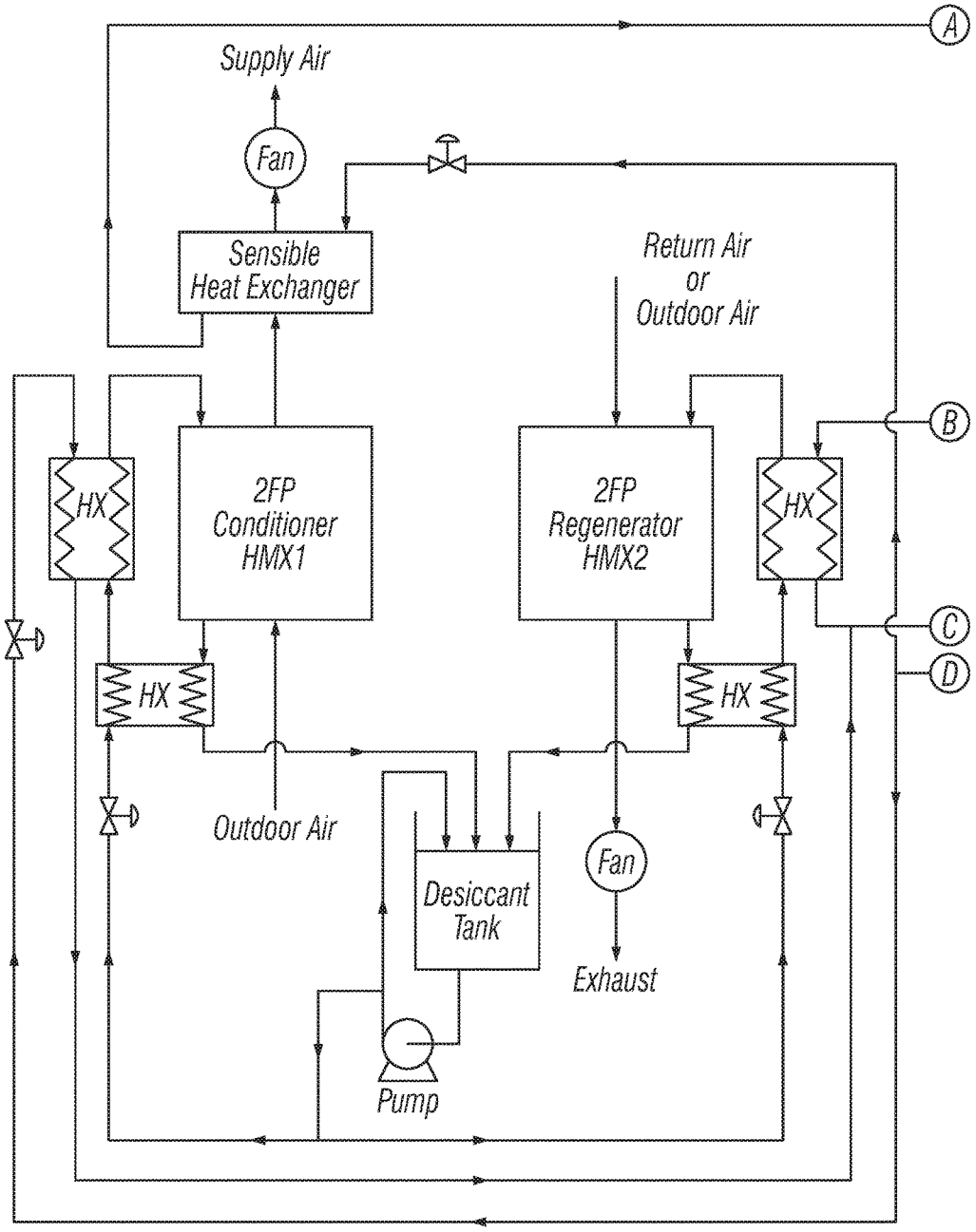
FIG. 12 is a schematic of another exemplary heat and mass transfer LDAC system using a first two-fluid path heat and mass transfer module for conditioning and a second two-fluid path heat and mass transfer module for regenerating.
Figure 12:
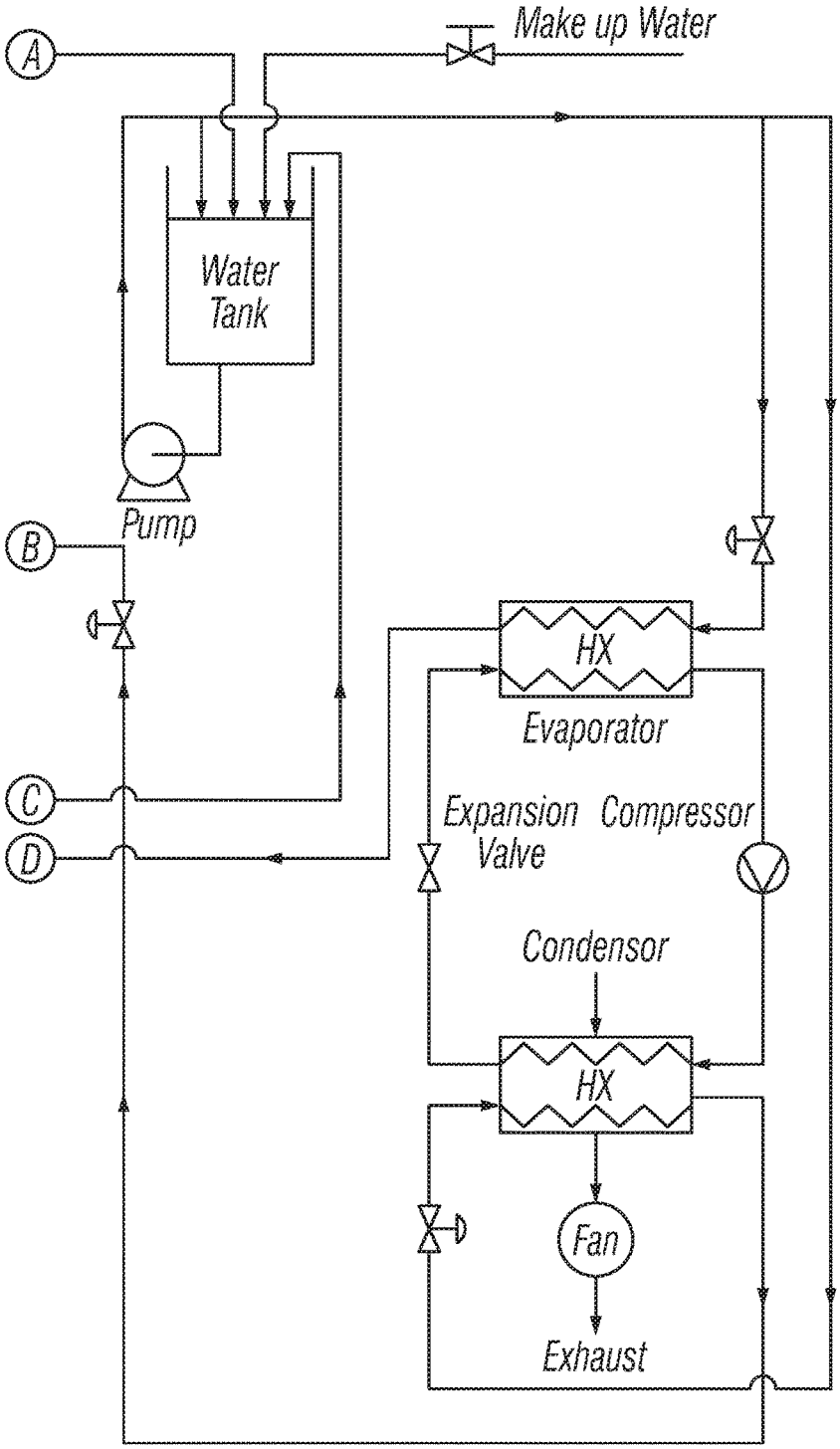

Heat and mass transfer systems incorporate any of the heat and mass transfer modules disclosed herein in conjunction with a desiccant supply. FIGS. 10-12 provide exemplary flow sheets of systems that may use any of the inventive heat and mass transfer modules disclosed herein. FIGS. 10, 11, and 12 depict LDAC systems incorporating HMX modules disclosed herein. FIGS. 10 and 12 depict LDAC systems incorporating two-fluid path HMX modules and FIG. 11 depicts a LDAC system incorporating three-fluid path HMX modules. All of the LDAC systems depicted utilize a vapor compression system to generate hot and cold heat exchange fluid. The heat exchange fluid may be water.

In FIG. 10, a LDAC system incorporating two-fluid path (2FP) HMX modules is configured wherein the liquid desiccant going into either the conditioner or the regenerator first passes through a heat exchanger which exchanges heat between the heat exchange fluid and the liquid desiccant prior to entering the HMX module. The heat exchanger may be made from corrosion resistant metals, coated metals, or plastic in order to prevent corrosion of the heat exchanger from the liquid desiccant. A first heat and mass transfer unit (HMX1) receives outdoor air that is conditioned to reduce humidity (latent load), and then directed to a sensible heat exchanger for temperature control, and then provided as supply air. Desiccant is cooled by a first heat exchanger (HX1) prior to entering HMX1 and circulated back to a desiccant tank upon exiting HMX1. A second heat and mass transfer unit (HMX2) receives return and/or outdoor air that is used to remove humidity from desiccant thereby regenerating it.

In FIG. 11, a LDAC system incorporating three-fluid path (3FP) HMX modules is depicted wherein the heat exchange fluid is introduced into the support structure which can be comprised of plates with internal heating and cooling channels. The plate exchanges heat directly with the liquid desiccant flowing on and in the layer in contact with the support structure. The plate may be made from corrosion resistant metals, coated metals, or plastics in order to prevent corrosion of the plates. The three-fluid path module design enables lower desiccant flow rates to be utilized as the temperature of the liquid desiccant can be maintained internal to the module which in turn maintains the vapor pressure differences driving the mass transfer in both the conditioner and regenerator. A first heat and mass transfer unit (HMX1) receives outdoor air that is conditioned to reduce humidity (latent load), and then directed to a sensible heat exchanger for temperature control, and then provided as supply air. Desiccant is circulated back to a desiccant tank upon exiting HMX1. A second heat and mass transfer unit (HMX2) receives return and/or outdoor air that is used to remove humidity from desiccant thereby regenerating it. Support plates of HMX1 receive cooling water to cool the desiccant during use.

In FIG. 12, a LDAC system incorporating two-fluid path (2FP) HMX modules is configured wherein the desiccant first goes through a desiccant to desiccant heat exchanger that exchanges heat between liquid desiccant leaving the HMX module and liquid desiccant flowing towards the HMX module. This additional heat exchanger provides internal system heat recovery which can boost LDAC system efficiency. After leaving the desiccant to desiccant heat exchanger, the liquid desiccant goes through a second heat exchanger which exchanges heat between the liquid desiccant and the heat transfer fluid in the same manner as the system shown in FIG. 10. A first heat and mass transfer unit (HMX1) receives outdoor air that is conditioned to reduce humidity (latent load), and then directed to a sensible heat exchanger for temperature control, and then provided as supply air. Desiccant is cooled by a first heat exchanger (HX1) prior to entering HMX1 and circulated back to a desiccant tank upon exiting HMX1. A second heat and mass transfer unit (HMX2) receives return and/or outdoor air that is used to remove humidity from desiccant thereby regenerating it. Additional heat exchangers are used relative to the system of FIG. 10 to further regulate the desiccant temperature.

Before describing several exemplary embodiments of the invention, it is to be understood that the invention is not limited to the details of construction or process steps set forth in the following description. The invention is capable of other embodiments and of being practiced or being carried out in various ways.

EXAMPLES

Example 1

Plasma Treatment of a Nylon Membrane

A nylon membrane web (BLA080) was plasma-treated using a mixture of a 2% silane ($SiH_4$) gas in argon, with oxygen in a MARC2 plasma system described in detail in U.S. Pat. No. 7,887,889 although different conditions were developed for this application. The power for these runs was maintained at 1000 watts. In a typical run, the chamber was pumped down to a base pressure of below 50 mTorr, and the process gas flow rates were adjusted and maintained, pressure controlled at a set point of 990 mTorr, plasma ignited at 1000 watts, and the web translated at the indicated speed, corresponding to a residence time of 30 seconds in the plasma.

Conditions for Plasma Treatment:

2% Silane in Argon Gas Flow Rate: 4000 std. $cm^3$/min

Oxygen Gas Flow Rate: 500 std. $cm^3$/min

Process Pressure: 990 mTorr

Plasma Power: 1000 watts

Web Speed: 10 ft/min

Stability of the desiccant-philic property was analyzed. Aqueous solutions of lithium chloride were prepared at different concentrations from 0% (water) to 40% in increments of 5%. The plasma-treated membrane wettability of these solutions was evaluated as a function of time, up to 113 days. The test used to evaluate the wettability of the membrane in this study was to place a drop on the surface of the membrane with the membrane in a horizontal orientation and record the time for the initiation of wetting rather than the complete disappearance of the drop. The plasma-treated membrane maintained a substantially unchanged level of wettability up to at least 113 days with the 35 wt % LiCl solution when evaluated with this test.

Example 2

A plasma-modified nylon membrane (BLA080) prepared according to Example 1 was prepared with lanes that were bordered by liquid-phobic stripes. The channel width was approximately ¼" formed by marking the membrane with ink from a marker that was phobic to a 35 wt-% lithium chloride solution. The membrane was assembled into a panel as shown in FIG. 7. Laning the membrane with this ink worked very effectively at providing phobic stripes which inhibited liquid crossover to another lane.

Figure 18:
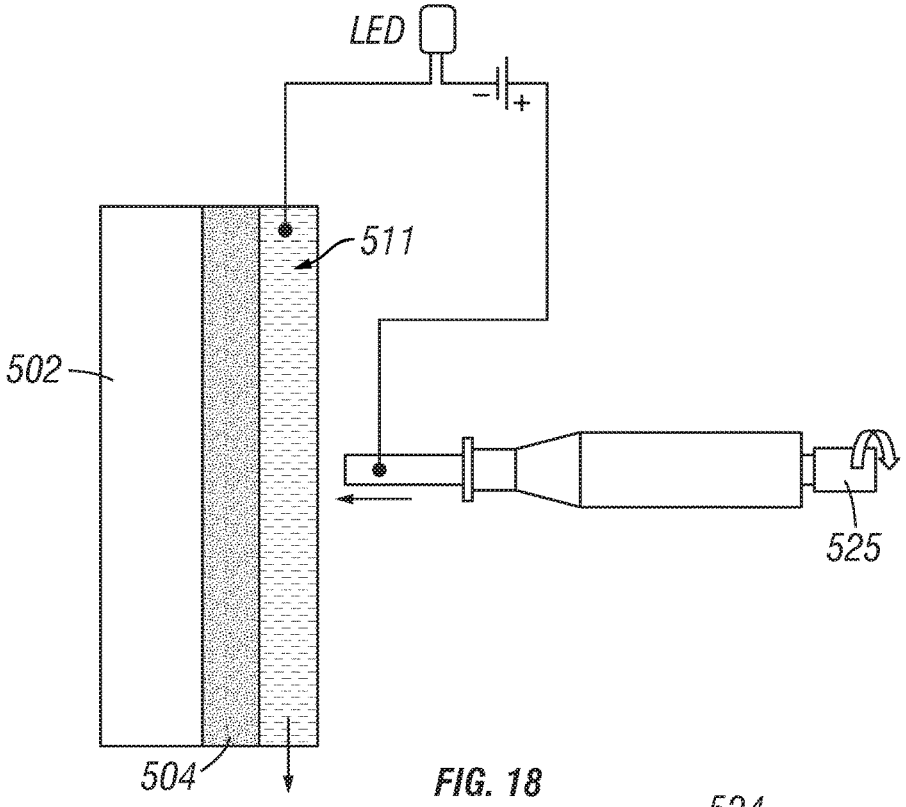
FIG. 18 provides a schematic of an apparatus to measure falling film thickness.

The thickness of falling liquid desiccant film on the membrane was measured by a custom-made apparatus, a schematic of which is shown in FIG. 18. The measurement principle was based on utilizing the electrical conductivity of the desiccant to detect the film face followed by using a micrometer head (least count 0.001") to measure the film thickness. Measurement was done at a total of nine points—three points (3.5" apart) across the film width (10") and three points down the film (6" apart). Desiccant flows on the wettable layer 504 (e.g., a membrane), which is supported by the support structure 502 (e.g., a plate) thereby forming a falling film 511. The procedure involved turning the micrometer spindle 525 towards the falling film 511 (as shown in FIG. 18) in about 0.001" increments until it touched the film's face, which was evidenced by lighting of the LED. Once the film face was detected, the spindle was turned until it touched the membrane, which was indicated by slipping of spindle's ratchet. The distance traveled by the spindle from film detection point to the surface of the membrane was recorded as the thickness of the falling desiccant film. This procedure was repeated for each of the three micrometers and values averaged to get a representative measurement for the entire 10" wide film at that location. The film thicknesses measured in these experiments ranged from 0.01"-0.03," with a trend of increasing film thickness with increasing flow rate.

Example 3

Various configurations of header geometries were tested with different forms of discrete fibrous sheets, which were assembled in contact with a support plate with a header that formed a gap for desiccant flow. The summary of media, geometries, and observations are provided in Table 1. Horizontal wicking test refers to the total time for a desiccant solution of 35 wt % LiCl to completely wick into the media when the media was horizontal. Each media tested had draw-and-drip features in the form of a crown (a series of triangular points uniformly-spaced) at the outlet end. Each media was installed with an acrylic support plate to receive gravity flow of the desiccant solution such that the surface of the media was vertical, in other words, the surface of the media was substantially parallel to the flow of desiccant.

TABLE 1

| No. | Media | Horizontal Wicking Test | Thicknesses | Liquid Head | Time for media to wet out with gravity feed |
|---|---|---|---|---|---|
| 3-A | SofPull (Georgia-Pacific) paper towel with paperboard backing | 36 seconds | Uncompressed thickness = 0.028"<br>Compressed thickness = 0.022"<br>Total thickness needed by shims = 0.032" | At 30 mL/min, <0.5"<br>At 60 mL/min, ~1.0" | 3 minutes |
| 3-B | Kimberly Clark paper towel with paperboard backing | 46 seconds | Uncompressed thickness = 0.028"<br>Compressed thickness = 0.022"<br>Total thickness needed by shims = 0.032" | At 30 mL/min, <0.50"<br>At 60 mL/min, ~0.75" | 4 minutes |
| 3-C | TSM 600 laminated to poster board | 15 seconds | Uncompressed thickness = 0.037"<br>Compressed thickness = 0.035"<br>Total thickness needed by shims = 0.045" | At 30 mL/min, <0.50"<br>At 60 mL/min, <0.50" | 10 minutes |
| 3-D | TSM 600 (no poster board) | 6 seconds | Uncompressed thickness = 0.022"<br>Compressed thickness = 0.020"<br>Total thickness needed by shims = 0.030" | At 30 mL/min, <0.50"<br>At 60 mL/min, >0.75" (slightly) | 5 minutes |
| 3-E | Kimberly-Clark paper towel with Delnet backing laminated to poster board | — | Compressed thickness = 0.035"<br>Shims used: 0.025" + 0.010" | At 30 mL/min, >0.50" (slightly)<br>At 60 mL/min, ~1.50" | 2 minutes |
| 3-F | 1MDS | 5 seconds | Uncompressed thickness = 0.050"<br>Compressed thickness = 0.018"<br>Total thickness needed by shims = 0.028" | At 30 mL/min, <0.50"<br>At 60 mL/min, <0.50" | 6:45 minutes |
| 3-G | TSM 300 | 5 seconds | Uncompressed thickness = 0.018"<br>Compressed thickness = 0.016"<br>Total thickness needed by shims = 0.026" | At 30 mL/min, <0.50"<br>At 60 mL/min, <0.50" | 6:20 minutes |
| 3-H | SofPull 26609 (Towel Only) | 25-30 seconds | Uncompressed thickness = 0.006"<br>Compressed thickness = | At 30 mL/min, <0.50"<br>At 60 mL/min, ~1.0" | 2:30 minutes |

TABLE 1-continued

| No. | Media | Horizontal Wicking Test | Thicknesses | Liquid Head | Time for media to wet out with gravity feed |
|---|---|---|---|---|---|
| | | | 0.005"<br>Total thickness needed by shims = 0.015" | | |
| 3-I | SofPull 26610 (Towel Only) | 25-30 seconds | Uncompressed thickness = 0.008"<br>Compressed thickness = 0.005"<br>Total thickness needed by shims = 0.015" | At 30 mL/min, <0.50"<br>At 60 mL/min, ~1.0" | 2:40 minutes |
| 3-J | Reemay 2214 Plasma-treated[a] | 30 seconds to 5 minutes depending on location | Uncompressed thickness = 0.007"<br>Compressed thickness = 0.006"<br>Total thickness needed by shims = 0.016" | At 30 mL/min, 0<br>At 60 mL/min, ~⅛" | 10 minutes |
| 3-K | Reemay 2214 Plasma-treated[a] with hydrophobic inked lanes | 30 seconds to 5 minutes depending on location | Uncompressed thickness = 0.007"<br>Compressed thickness = 0.006"<br>Total thickness needed by shims = 0.016" | At 30 mL/min, 0<br>At 60 mL/min, ~¼"<br>At 90 mL/min, ½"<br>At 120 mL/min, ¾" | 3 minutes |
| 3-L | 2 sheets of Reemay 2214 Plasma-treated[a] 1 sheet with hydrophobic inked lanes against the support plate, the other sheet had no lanes. | 30 seconds to 5 minutes depending on location | Compressed thickness = 0.012" | At 30 mL/min, ~2" | 6 minutes |
| 3-M COMPARATIVE | Woven Cotton | No wicking at all | Uncompressed thickness = 0.053"<br>Compressed thickness = 0.044"<br>Total thickness needed by shims = 0.054" | — | — |

[a]= Plasma-treatment: % silane in argon gas flow rate: 4000 std. $cm^3$/min
Oxygen gas flow rate: 500 std. $cm^3$/min
Process pressure: 990 mTorr
Plasma power: 1000 W
Line speed: 2 ft./min For 3-A, as the desiccant emerged from the gap into and onto the layer, it initially streaked with beaded ends but only for about 20 seconds, then it began to wick into the layer and drain out the crowns. Once the layer was fully wetted, there were ribbons running down the surface of the layer although they were barely visible and all of the flow out of the crowns was even.

For 3-B, as the desiccant emerged from the gap into and onto the layer, it initially streaked with beaded ends for about 40 seconds, then it began to wick into the layer and drain out the crown. Once the layer was fully wetted, there were visible ribbons running down the surface of the layer more than observed on 3-A (SofPull media).

For 3-C, as the desiccant emerged from the gap into and onto the layer, it initially streaked with beaded ends. Once the layer was fully wetted, there were visible ribbons running down the surface of the layer.

For 3-D, as the desiccant emerged from the gap into and onto the layer, it initially streaked with beaded ends although the beads were not nearly as pronounced as with 3-C (the same layer with poster board). Once the media was fully wetted, there were visible ribbons running down the surface of the layer. Also, the layer began to buckle and form curves during testing.

For 3-E, no beaded streaks were seen during the initial wetting out of the layer. There was buckling of the layer during testing. At 30 mL/min and 60 mL/min, flow from the crowns was not entirely even across the bottom. There were no visible ribbons on top of the layer during testing. The desiccant was observed flowing between the Delnet material and the paper towel which together comprise the layer. This was discovered by noticing that the beads dropping from the crowns were coming out on top of the Delnet material and lifting up the end of the crown points as the fell.

For 3-F, as the desiccant emerged from the gap into and onto the layer, it formed ribbons down to the crown, expanding outward as it flowed. Once the media was fully wetted, there were still ribbons running down the surface of the layer and all of the flow out of the crowns was even.

For 3-G, as the desiccant emerged from the gap into and onto the layer, it formed ribbons down to the crowns, expanding outward as it flowed. Once the layer was fully wetted, there were still ribbons running down the surface of the layer. The flow out of the crowns was uneven.

For 3-H and 3-I, as the desiccant emerged from the gap into and onto the layer, it initially streaked with beaded ends down to the crown. Once the layer was fully wetted, there were ribbons running down the surface of the layer. The flow out of the crowns was uneven.

For 3-J, as the desiccant emerged from the gap into and onto the layer, it streaked with beaded ends down to the crowns. Once the layer was wetted (some dry patches were still observed after 8 minutes), there were ribbons running down the surface of the layer. The flow out of the crowns was uneven especially at 30 mL/min. At 60 mL/min the flow from the crowns evened out somewhat. Desiccant was observed flowing over the surface of the layer.

For 3-K, hydrophobic ink was added to the Reemay layer of 3-J to form lanes. As the desiccant emerged from the gap into and onto the layer, there was a noticeable decrease in the thickness of the ribbons that were visible running down the layer. During the initial wet out of the layer, there were no visible drops running down the ink. The ribbons were easy to see right under the header but flattened out the lower they traveled down the surface of the layer. The flow out of the crowns was relatively even at all flow rates.

For 3-L, two sheets of Reemay media were used to form the layer and fill the gap, one having inked lanes which were located against the support plate and the other without. The layer was located on the plate such that the crowns were ¼" above the bottom of the plate. As the desiccant emerged from the layer in the gap, there were small ribbons expressed on the surface at several spots along the layer close to the header. During the initial wet out of the layer, there were no visible drops running down the ink. The ribbons were easy to see right under the header but flattened out the lower they traveled down the surface of the layer. The flow out of the crowns was relatively even at all flow rates.

For Comparative 3-M, the desiccant did not absorb into the layer at all but rather ran down the layer in beads. Even after using a squeegee to try to coax the desiccant into the layer, the desiccant still beaded off into a catch basin. These same results were taken from the following materials: cork, beige fabric, card stock, glitter cardboard, landscape mock material, and felt (flocked) poster board.

Example 3-N

Another configuration of header geometry was prepared according to FIG. 21: a strip of 10 mil Delnet was located between two wettable layers. The wettable layers were wettable fibrous sheets, Reemay 2214 Spunbond Polyester, that fully wet with a drop of 35% lithium chloride in water solution in 300 seconds or less. The wettable layers were assembled into a heat and mass transfer panel in such a manner that the two wettable layers with the 10 mil Delnet strip located therebetween was pinched in the flow gap created by the fluid distribution system. Both layers were located on one side of the panel and against the support structure. Liquid desiccant was fed into the gap and travelled down the channels in the Delnet gap material which is oriented in a manner such that the channels were in the vertical direction. The Delnet strip was cut to be the same height as the gap height. The gap material allowed fluid to exit the gap between the wettable layers. This enabled the fluid to flow in a very uniform and controlled manner. Draw-and-drip features were located at the bottom of the wettable layers. The desiccant spread quite evenly across the wettable layers. This design minimizes the chance for desiccant drips, beads, or streaks to form at the exit of the gap which might lead to aerosolized desiccant during use.

Example 4

A falling film heat and mass transfer (HMX) module was produced using a plurality of acrylic plates as both support structures and end plates. To make a wettable membrane, the membrane was pre-wet with water and then immersed in liquid desiccant so the salt could diffuse into the liquid in the membrane pores. The wettable membrane having draw-and-drip features in the form of crowns was then attached to each of the support structures at the top using a 3M double sided adhesive tape. Shim stock of various thicknesses in combination with the support structures were used to create header gaps which fed liquid desiccant onto each side of each support plate. Footers were produced in a similar manner. The support plates were ⅛" thick. Two ½" thick end plates were used in combination with six threaded tie rods to securely bring the plates into contact and provide sealing between plates at the header which resulted in the formation of an upper reservoir. The headers and footers also provided for the air gap spacing which was approximately ¼". The module was mounted in a test duct of a heat and mass transfer performance test stand and sealed so that the air passed in a cross-flow manner, or horizontally, between the plates and passed the falling liquid desiccant films delivered from the reservoir. The desiccant flowed to the membrane crown features, through the footers, out of the module, and dripped into a collection pan mounted on the test stand where it could be recirculated. The desiccant feed at the top of the module and desiccant collection at the bottom of the module occurred outside the air stream being treated to minimize any potential for carryover of the desiccant. Only the falling films in the membrane and on the surfaces of the membrane were exposed to the air stream. Module volume (excluding end plates)=10.5"12"×5"=630 $in^3$ (0.0103 $m^3$).

The performance test stand was capable of supplying hot and humid air of a known composition to the module located in the test duct. Performance of the module can be characterized by monitoring the outlet conditions generated by the module for any given inlet condition. The test stand contained controls and instrumentation so the following variables could be controlled and/or measured during either conditioning or regeneration modes of operation: Air Flow Rate, Inlet Air Dry Bulb Temperature, Inlet Air Relative Humidity, Desiccant Flow Rate, Desiccant Inlet Temperature, Desiccant Outlet Temperature, Desiccant Concentration at the Outlet, Outlet Air Dry Bulb Temperature, and Outlet Air Relative Humidity.

The performance was characterized by calculating latent, $\varepsilon_l$ and sensible, $\varepsilon_s$ effectiveness defined as:

$$\varepsilon_l = \frac{\omega_i - \omega_o}{\omega_i - \omega_{min}(T_{d,i}, x_i)} \quad (1)$$

$$\varepsilon_s = \frac{T_{db,i} - T_{db,o}}{T_{db,i} - T_{d,i}} \quad (2)$$

where $\omega_l$ and $\omega_o$ are the humidity ratios of air at the inlet and outlet of the panel (or module), respectively, and $\omega_{min}$ ($T_{d,i}$, $x_i$) is the minimum possible humidity ratio of the air at the outlet corresponding to the desiccant temperature, $T_{d,i}$ and concentration (mass fraction), $x_i$ at module inlet. In Eq. (2), $T_{db,i}$ and $T_{db,o}$ are the air dry bulb temperatures at the inlet and outlet of the panel (or module).

Test results for this prototype module are provided in Tables 2-3.

TABLE 2

Test conditions- Conditioning mode

| No. | Air flow rate, CFM | Air dry-bulb temp. ° C. | Air RH (%) | Desiccant flow rate, LPM | Desiccant temp. ° C. | Desiccant concen-tration (%) |
|---|---|---|---|---|---|---|
| 1 | 18 | 33.1 | 50 | 2.8 | 19.2 | 35 |
| 2 | 18 | 34.4 | 55 | 2.8 | 18.8 | 35 |
| 3 | 27 | 32.3 | 80 | 2.8 | 17.6 | 35 |
| 4 | 27 | 31.2 | 75 | 2.8 | 18.6 | 35 |

TABLE 3

Results: outlet air readings taken with handheld temp/humidity probe (Omega HH314)

| No. | Outlet air dry-bulb temp. ° C. | Outlet air RH (%) | Sensible effective-ness (%) | Outlet desiccant temp. ° C. | Latent effective-ness (%) | Power density (kW/m$^3$) |
|---|---|---|---|---|---|---|
| 1 | 25.1 | 33 | 57 | 22.4 | 78 | 31 |
| 2 | 26.6 | 32 | 50 | 23 | 79 | 38 |
| 3 | 27.1 | 60 | 34 | — | 52 | 49 |
| 4 | 27.0 | 55.5 | 33 | — | 52 | 41 |

The air-side pressure drop across the module in tests 1 and 2 was measured to be extremely low (~1 Pa).

Example 5

A HMX module was produced using Norplex Micarta plates as both support structures and end plates. The thickness for each support structure was 0.015". The end plates were 0.50" thick. Header and footer components were also fabricated from laser-cut Micarta. A plasma-modified hydrophilic nylon 6,6 membrane with hydrophobic laning of the design of the membrane of Example 2 was used. The air gap spacing between each panel was approximately 0.100". 10 mil Delnet was utilized to create the gap spacing. The smaller spacing between panels in this module improved the packing density and performance of the module. Small foam spacers were also added between panels about halfway between the header and footer to stabilize the plates during the expected thermal expansion and contraction which occurs during operation of the module. The module dimensions were 6½" wide by 12" high by 10½" deep including the upper reservoir and footers, which resulted in 819 in$^3$ module volume (including end plates) (0.0134 m$^3$).

The module was performance tested for heat and mass transfer at AHRI Standard 920 air inlet conditions. The ANSI/AHRI 920 Standard is entitled "Performance Rating of DX-Dedicated Outdoor Air System Units" and provides a reference on how to test air conditioners which process 100% outside air for ventilation. The inlet air for the "A" conditions per the ANSI/AHRI 920 Standard is a dry bulb temperature of 35° C. and a wet bulb temperature of 26° C. This equates to a relative humidity of approximately 49%. The module was tested at various air flow rates and plots of latent and sensible effectiveness were developed. In addition the power density of the module was calculated for each test point. Power density is defined as the amount of power (rate at which work is done P=work/time or P=energy/time) divided by the total volume of the module. The total volume of the module includes the headers and footers, not just the direct contactor volume.

Figure 13:
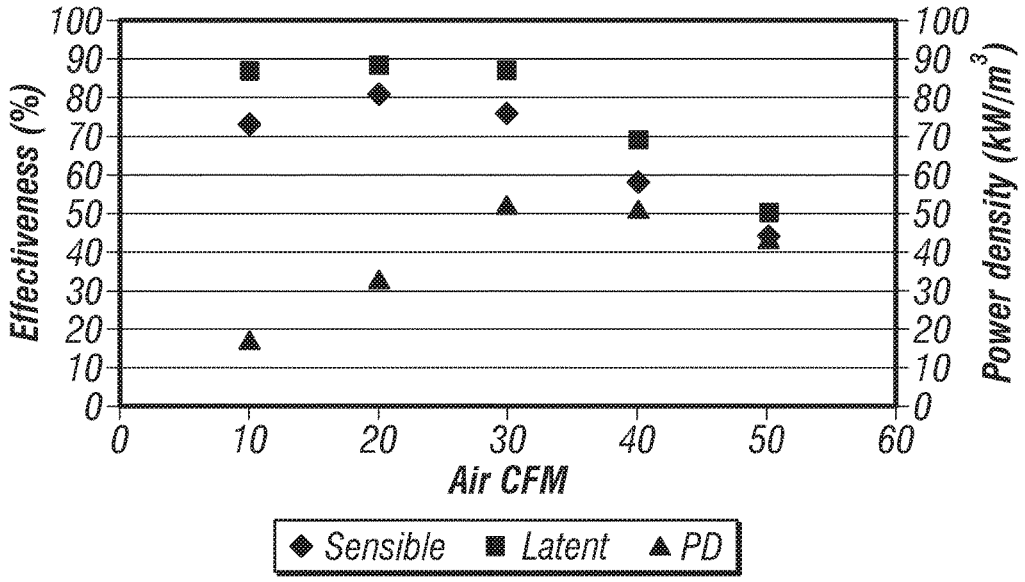
FIGS. 13-14 provide graphs of conditioner mode testing of the module of Example 6.
Figure 14:
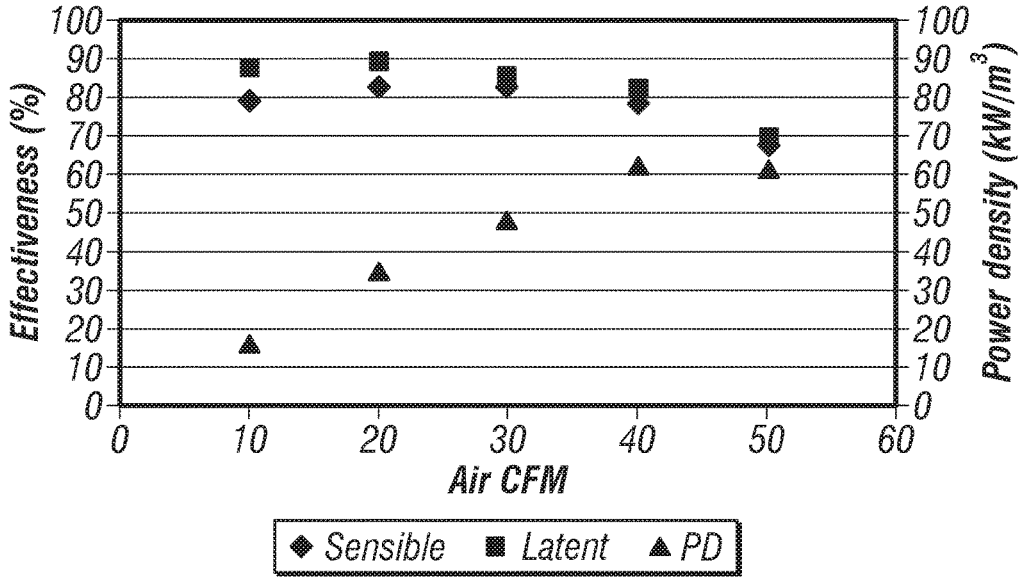

The desiccant utilized was a LiCl solution with a concentration of approximately 35%. The desiccant inlet temperature was approximately 20° C. Two different nominal desiccant flow rates were profiled in the studies (1 liter per minute (LPM) and 2 LPM). The conditioner performance was profiled as a function of air flow rate through the module. Graphs of the results of the Example 5 module conditioner performance at Air-Conditioning, Heating, & Refrigeration Institute) AHRI standard 920 conditions are provided in FIGS. 13-14. FIG. 13 provides results of sensible and latent effectiveness % and power density (kW/m$^3$) versus Air CFM at a desiccant flow rate of ~1 LPM and FIG. 14 provides results of sensible and latent effectiveness % and power density (kW/m$^3$) versus Air CFM at a desiccant flow rate of ~2 LPM.

Figure 15:
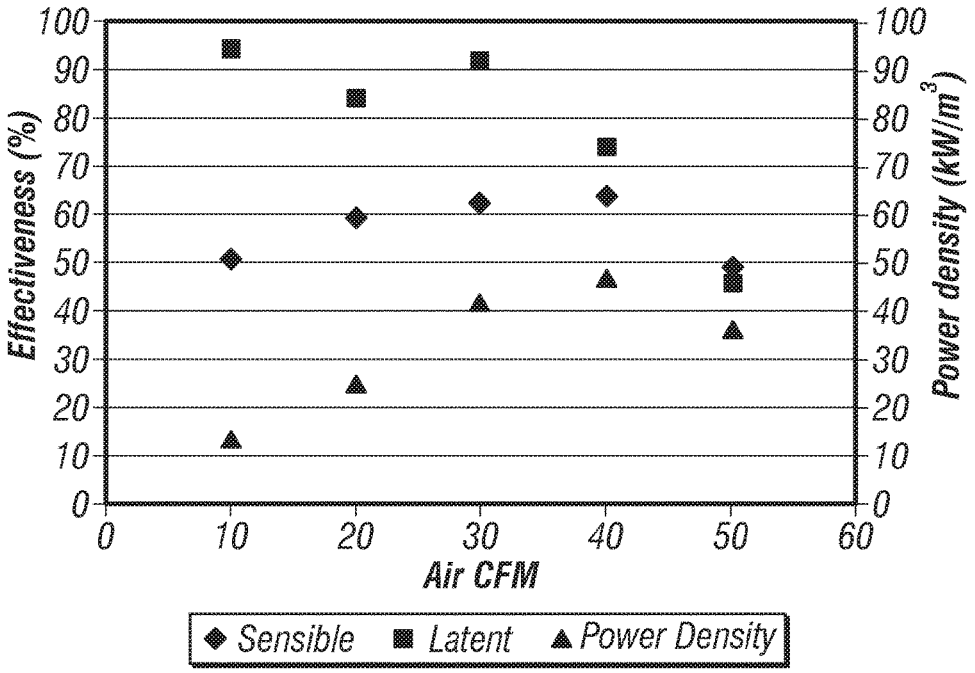
FIG. 15 provides a graph of regenerator mode testing of the module of Example 6.

For testing of regenerator performance, the desiccant flow rate was monitored for each test point and ranged from approximately 1.1 LPM to 2.7 LPM. The effect of the desiccant flow rate is included in the effectiveness and power density calculations. The desiccant inlet temperature was approximately 40° C. Room air was used for the regeneration mode. The dry bulb temperature of the inlet air ranged from 24.5° C. to 26.1° C. and the relative humidity ranged from 36% to 48%. A graph of the results of the Example 5 module regenerator performance is provided in FIG. 15. FIG. 15 provides results of sensible and latent effectiveness % and power density (kW/m$^3$) versus Air CFM.

Example 6

A HMX module was produced in the same manner as Example 6 with the modifications of using a plasma-modified hydrophilic nylon 6,6 membrane without hydrophobic laning of the design of the membrane of Example 1, and the underside of the headers were treated with a superhydrophobic coating (Rustoleum NeverWet®) to enhance the detachment of the desiccant from the header to the membrane. This coating eliminated any internal dripping in the module and insured uniform liquid film formation on the membrane surfaces, which is important to insure that any chance of desiccant aerosolization and carryover is minimized. This module also utilized a 10 mil Delnet (PP apertured film) to create the desiccant feed gap in the header.

The desiccant utilized was a LiCl solution with a concentration of approximately 35%. The desiccant inlet temperature was approximately 20° C. A nominal desiccant flow rate of 1 liter per minute (LPM) was profiled in the study.

Figure 16:
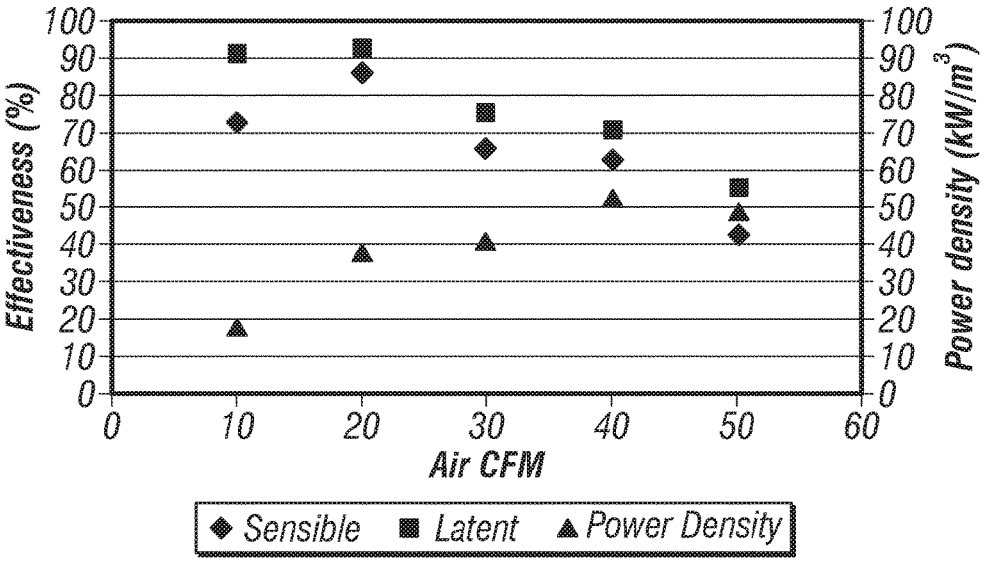
FIG. 16 provides a graph of conditioner mode testing of the module of Example 7.

The conditioner performance was profiled as a function of air flow rate through the module. A graph of the results of the Example 6 module conditioner performance at Air-Conditioning, Heating, & Refrigeration Institute) AHRI standard 920 conditions is provided in FIG. 16. FIG. 16 provides results of sensible and latent effectiveness % and power density (kW/$m^3$) versus Air CFM at a desiccant flow rate of ~1 LPM.

Figure 17:
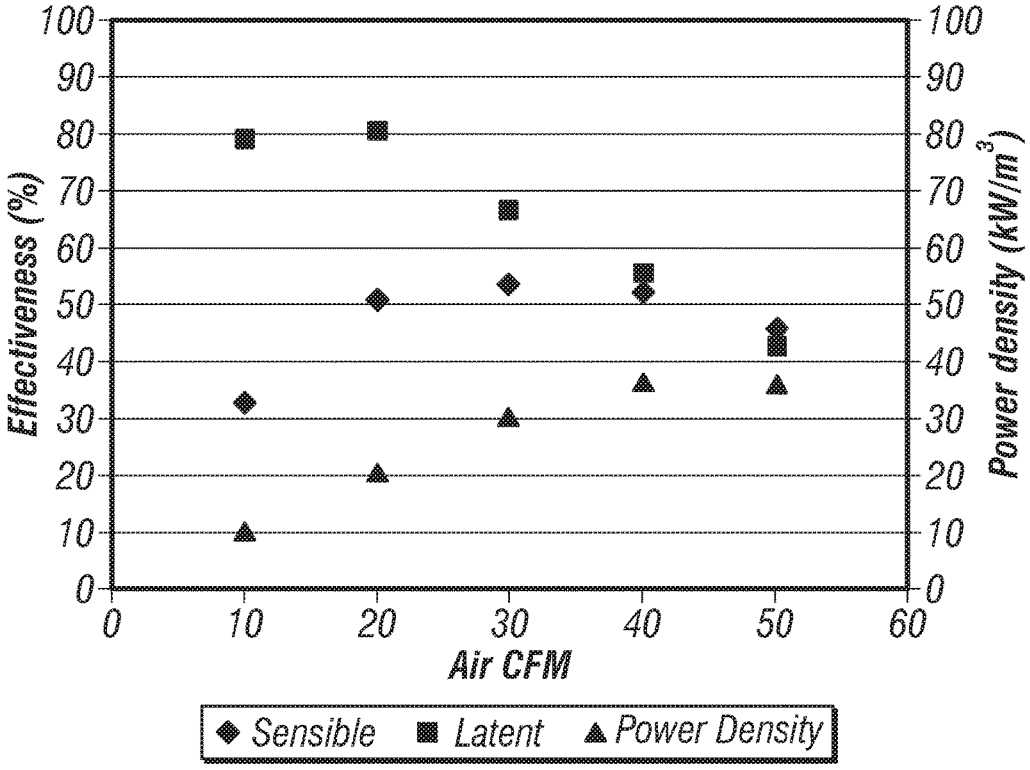
FIG. 17 provides a graph of regenerator mode testing of the module of Example 7.

For testing of regenerator performance, the desiccant flow rate was monitored. The effect of the desiccant flow rate is included in the effectiveness and power density calculations. The desiccant inlet temperature was approximately 40° C. Room air was used for the regeneration mode. The dry bulb temperature of the inlet air ranged from 24.5° C. to 26.1° C. and the relative humidity ranged from 36% to 48%. A graph of the results of the Example 6 module regenerator performance is provided in FIG. 17. FIG. 17 provides results of sensible and latent effectiveness % and power density (kW/$m^3$) versus Air CFM.

Example 7

Testing

A performance test stand using the HMX modules of Examples 5-6 was also tested for carryover of LiCl as a function of flow rate and design. Minimizing to eliminating aerosolization of the liquid desiccant during operation is a goal. The desiccant is typically a lithium chloride solution which is very corrosive. Upon entrainment in a conditioned air stream, it can cause equipment and ductwork corrosion and may create an environmental, health and safety issue. A test protocol was developed to test for the presence of lithium downstream from the module during operation.

The performance test stand had a reducing section after the module which reduced the cross-section of the duct to a 3" wide by 2" high opening that was 31" from the discharge end of the module being tested. A gas capture cassette with a porous membrane was located at this discharge point and attached to an air sampling pump in order to measure the amount of LiCl release from the module during operation. After sampling, an extraction of the porous membrane was conducted and analyzed using ICP analysis to quantify the amount of lithium present. Calculations were done to determine the concentration of lithium in the air stream. Testing was conducted at several different air flow rates through the module. Table 4 summarizes the results for Example 5 and Table 5 summarizes the results for Example 6.

TABLE 4

Example 5 as tested

| Desiccant CFM | Air Volume Sampled (L) | Total Li (μg/L) | Quantity in 4000 hours of Operation (g) |
|---|---|---|---|
| 30 | 114.5 | 1.7 | 0.06 |
| 40 | 142.6 | ND | ND |
| 50 | 128 | 18.5 | 0.98 |

TABLE 5

Example 6 as tested

| Desiccant CFM | Air Volume Sampled (L) | Total Li (μg/L) | Quantity in 4000 hours of Operation (g) |
|---|---|---|---|
| 30 | 130 | ND | ND |
| 40 | 128 | ND | ND |
| 50 | 130 | ND | ND |

The prototype modules of Examples 5-6 also exhibited the ability to handle the thermal stresses and temperature cycling over the range of approximately 15° C. to 40° C. based upon switching back and forth between conditioner mode and regeneration mode during performance testing.

Pressure drop for Examples 5-6 was also determined as a function of air flow, results for which are provided in Table 6.

TABLE 6

Example 6 as tested

| Air flow (CFM) | Pressure Drop (Pa) |
|---|---|
| 10 | 1.74 |
| 20 | 4.48 |
| 30 | 7.72 |
| 40 | 9.96 |
| 50 | 13.5 |

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Furthermore, the particular features, structures, materials, or characteristics may be combined in any suitable manner in one or more embodiments.

Although the invention herein has been described with reference to particular embodiments, it is to be understood that these embodiments are merely illustrative of the principles and applications of the present invention. It will be apparent to those skilled in the art that various modifications and variations can be made to the method and apparatus of the present invention without departing from the spirit and scope of the invention. Thus, it is intended that the present invention include modifications and variations that are within the scope of the appended claims and their equivalents.

What is claimed is:

1. A heat and mass transfer module comprising:

one or more support structures;

one or more wettable layers in contact with the support structure;

a gas contact zone adjacent to the wettable layer;

a fluid distribution system comprising one or more headers that define a fluid reservoir; and a fluid collection system comprising one or more footers having a stepped feature; and at least one end plate.

2. The heat and mass transfer module of claim 1, wherein the wettable layers are effective to form a falling film of a liquid desiccant upon receipt of a gravity feed of the liquid desiccant.

3. The heat and mass transfer module of claim 2 further comprising two end plates.

4. The heat and mass transfer module of claim 2 comprising a plurality of panels.

5. The heat and mass transfer module of claim 2 further comprising an air inlet opening and an air outlet opening, wherein air flow is cross-flow to the falling film of the liquid desiccant.

6. The heat and mass transfer module of claim 5, wherein upon receipt of the falling film of the liquid desiccant, a panel comprises an upper liquid seal and a lower liquid seal, which are effective to inhibit loss of air through the fluid distribution system and the fluid collection system, respectively.

7. The heat and mass transfer module of claim 4, wherein the fluid distribution system comprises a plurality of headers arranged such that a plurality of air flow gaps are defined therebetween.

8. The heat and mass transfer module of claim 7, wherein the air flow gaps are substantially uniform.

9. The heat and mass transfer module of claim 4, wherein the fluid distribution system comprises a plurality of shims located between the plurality of panels.

10. The heat and mass transfer module of claim 7, wherein each of the headers comprises desiccant flow features.

11. The heat and mass transfer module of claim 4, wherein the fluid collection system comprises a plurality of footers arranged such that a plurality of collection gaps are defined therebetween.

12. The heat and mass transfer module of claim 11, wherein each footer comprises a stepped feature to form a reservoir defined by the footer at the outlet end of the layer.

13. The heat and mass transfer module of claim 11, wherein the collection gaps are substantially uniform.

14. The heat and mass transfer module of claim 5 further comprising one or both of the following: a first air filter upstream of the air inlet opening and a second air filter downstream of the air outlet opening.

15. The heat and mass transfer module of claim 14, wherein the first and second air filters independently comprise a pleated air filter.

16. A heat and mass transfer system comprising:

one or more modules according to claim 1; and a desiccant supply.

17. The heat and mass transfer system of claim 16, further comprising a heat transfer fluid supply.

18. The heat and mass transfer system of claim 16 comprising:

a first module that upon contact with air having a water vapor pressure higher than the equilibrium vapor pressure of the desiccant, is effective to transfer water vapor from the air to a desiccant flowing through the desiccant channel; and a second module that upon contact with air having a water vapor pressure lower than the equilibrium vapor pressure of the desiccant is effective to transfer water vapor from the desiccant to the air.

19. The heat and mass transfer system of claim 18, further comprising a sensible heat exchanger downstream of the first module.

20. A method for water vapor exchange between air and a liquid desiccant, the method comprising:

contacting the module of claim 1 with air having a water vapor pressure different from the equilibrium vapor pressure in a desiccant flowing through the desiccant flow channel;

wherein the humidity of the air after contact with the module is different from the humidity before contact with the module.

21. The method for water vapor exchange of claim 20, wherein the water vapor pressure of the air is higher than the equilibrium vapor pressure of the desiccant, the method further comprising transferring the water vapor from the air to the desiccant, and the humidity of the air after contact with the module is less than the humidity before contact with the module.

22. The method for water vapor exchange of claim 20, wherein the equilibrium vapor pressure of the desiccant is higher than the water vapor pressure of the air, the method further comprising transferring the water vapor from the desiccant to the air, and the humidity of the air after contact with the module is more than the humidity before contact with the module.

23. A method of making a heat and mass transfer module, the method comprising:

forming a gas contact zone adjacent to one or more support structures by assembling the one or more support structures with at least one end plate, a fluid distribution system comprising one or more headers that define a fluid reservoir, and a fluid collection system comprising one or more footers having a stepped feature to form the module.

24. The method of claim 23 further comprising contacting the one or more support structures with one or more wettable layers.

* * * * *